US008257898B2

(12) United States Patent
Norikane et al.

(10) Patent No.: US 8,257,898 B2
(45) Date of Patent: Sep. 4, 2012

(54) METHOD OF MANUFACTURING A TONER, DEVICE OF MANUFACTURING A TONER, AND TONER

(75) Inventors: Yoshihiro Norikane, Kanagawa (JP); Shinji Aoki, Kanagawa (JP); Tetsuya Sonoda, Kanagawa (JP); Keisuke Uchida, Tokyo (JP); Andrew Mwaniki Mulwa, Kanagawa (JP); Yuko Sekiguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 506 days.

(21) Appl. No.: 12/547,927

(22) Filed: Aug. 26, 2009

(65) Prior Publication Data

US 2010/0055600 A1 Mar. 4, 2010

(30) Foreign Application Priority Data

Sep. 1, 2008 (JP) ..... 2008-224063

(51) Int. Cl.
*G03G 9/08* (2006.01)

(52) U.S. Cl. ..... 430/137.1

(58) Field of Classification Search ..... 430/137.1
See application file for complete search history.

(56) References Cited

U.S. PATENT DOCUMENTS

| | | | | |
|---|---|---|---|---|
| 2003/0224271 | A1* | 12/2003 | Teshima | 430/105 |
| 2004/0048183 | A1* | 3/2004 | Teshima | 430/137.1 |
| 2009/0117486 | A1 | 5/2009 | Watanabe et al. | |
| 2009/0170018 | A1 | 7/2009 | Kuramoto et al. | |
| 2009/0226837 | A1 | 9/2009 | Norikane et al. | |
| 2009/0239170 | A1 | 9/2009 | Honda et al. | |

FOREIGN PATENT DOCUMENTS

| | | |
|---|---|---|
| JP | 57-201248 | 12/1982 |
| JP | 7-152202 | 6/1995 |
| JP | 3786034 | 3/2006 |
| JP | 3786035 | 3/2006 |
| JP | 2006-293320 | 10/2006 |
| JP | 2006-297325 | 11/2006 |
| JP | 2008-276146 | 11/2008 |

OTHER PUBLICATIONS

U.S. Appl. No. 12/488,843, filed Jun. 22, 2009, Honda, et al.
U.S. Appl. No. 12/503,444, filed Jul. 15, 2009, Watanabe, et al.

* cited by examiner

*Primary Examiner* — Hoa V Le
(74) *Attorney, Agent, or Firm* — Oblon, Spivak, McClelland, Maier & Neustadt, L.L.P.

(57) ABSTRACT

Disclosed is a method of manufacturing a toner, wherein a liquid drop forming part including a storage part configured to store a toner composition liquid in which a toner composition including at least a resin and a coloring agent is dispersed or dissolved, a thin film on which a nozzle facing the storage part is formed, and a vibration generating part configured to vibrate the thin film via the toner composition liquid in the storage part are used, wherein plural storage chambers partitioned by a partition wall(s) are formed in the storage part and a width of each storage chamber in a direction of arrangement of the plural storage chambers and a width of each storage chamber in a direction orthogonal to the direction of arrangement of the storage chambers are formed to be one-half or less of a wavelength λ of a sonic wave generated in the storage part.

8 Claims, 8 Drawing Sheets

METHOD OF MANUFACTURING A TONER, DEVICE OF MANUFACTURING A TONER, AND TONER

BACKGROUND OF THE INVENTION

1. Field of the Invention

The present invention relates to a method of manufacturing a toner, a device of manufacturing a toner, and a toner.

2. Description of the Related Art

A developer to be used to develop an electrostatic image in electrophotography, electrostatic recording, electrostatic printing, or the like, for example, once adheres to an image carrier such as an electrostatic latent image supporter on which an electrostatic image is formed, in its development process, then transfers from the electrostatic latent image supporter to a transfer medium such as a transfer paper sheet in a transfer process, and subsequently is fixed on the surface of the paper sheet in a fixation process. In this case, a two-component-type developer composed of a carrier and a toner and a one-component-type developer needing no carrier (a magnetic toner or a non-magnetic toner) have been known as developers for developing an electrostatic image formed on a latent image holding surface.

Conventionally, a so-called grinded toner provided by melting and kneading a toner binder such as a styrene-type resin or a polyester-type resin, a coloring agent, etc., and milling it has been widely used as a dry-type toner to be used for electrophotography, electrostatic recording, electrostatic printing, or the like.

Recently, a method for manufacturing a toner based on a suspension polymerization method or an emulsification polymerization aggregation method, a so-called polymerization-type toner has been examined. In addition, a manufacturing method involving volume shrinkage, referred to as a polymer dissolution suspension method has also been examined (see Japanese Patent Application Publication No. H07-152202). This method is to disperse and dissolve toner materials in a volatile solvent such as a low-boiling-point organic solvent, then emulsify it in an aqueous medium in which a dispersing agent is present, so as to form into a liquid drop, and subsequently remove the volatile solvent. This method is different from a suspension polymerization method and an emulsification polymerization aggregation method in that there is a wide versatility in usable resins, and in particular, excellent in that it may be possible to use a polyester resin useful for a full-color process in which a transparency or a smoothness of an image portion after its fixation is required.

However, it has been known that, for example, a disadvantage may be caused such that a dispersing agent degrading a toner charging characteristic remains on a toner surface so as to degrade its environmental stability, or a enormous amount of washing water may be required for eliminating it, in the above-mentioned polymerization-type toner, because it is based on the premise that a dispersing agent is used in an aqueous medium, and it is not necessarily a satisfactory manufacturing method.

Meanwhile, a spray drying method has been known as a method for manufacturing a toner using no aqueous medium conventionally (see Japanese Examined Patent Application Publication No. S57-201248). Because this is to form into a fine particle, to eject, and to dry, a melt of toner components or a liquid in toner component liquid is dissolved, using various atomizers, to obtain a particle, no disadvantage may be caused by using an aqueous medium.

However, a particle obtained by a conventional spray particle-manufacturing method is comparatively coarse and large and its particle size distribution is also wide, which may accordingly cause degradation of the intrinsic characteristics of a toner.

Then, for a toner manufacturing method replacing it, a method and device for forming a fine liquid drop utilizing a piezoelectric pulse and further drying and solidifying it to provide a toner have been proposed (see Japanese Patent No. 3786034). Furthermore, a manufacturing method for forming a fine liquid particle utilizing thermal expansion in a nozzle and further drying and solidifying it to provide a toner has also been proposed (see Japanese Patent No. 3786035).

However, it may merely be possible to conduct liquid drop ejection from one nozzle using one piezoelectric body and the number of liquid drops which can be ejected in a unit of time may be small, in the methods and device for manufacturing a toner as disclosed in the aforementioned Japanese Patent No. 3786034 and Japanese Patent No. 3786035, whereby there may be a problem of low productivity.

Then, it has been proposed that a toner particle is provided by vibrating a nozzle due to stretching of a piezoelectric body as vibration generation means so as to eject a liquid drop of a toner composition fluid from the nozzle at a constant frequency and solidifying that liquid as disclosed in Japanese Patent Application Publication No. 2006-293320, and an ejection member having an ejection port and vibration applying means for applying vibration to that ejection member at a predetermined frequency are included wherein a toner particle is manufactured by vibrating the ejection member as a vibration member so as to eject a liquid drop from the ejection port and drying and solidifying the liquid drop as disclosed in Japanese Patent Application Publication No. 2006-297325.

However, in a configuration such that a piezoelectric body is put close to the peripheral portion of a nozzle as described above and the nozzle is vibrated by means of stretching of the piezoelectric body so as to form into a liquid drop and eject a toner composition liquid, vibration is merely generated at a nozzle region in a region corresponding to an aperture portion of the piezoelectric body, and accordingly, it may be impossible to obtain a large deformation of the nozzle. That is, when a toner composition liquid with a high viscosity (for example, 10 mPa·s) in which a large quantity of solid content is dispersed is ejected, clogging may occur readily and the configuration is yet insufficient in order to manufacture a toner stably and efficiently.

Then, the inventors have actively examined a configuration using vibration generating means for vibrating a thin film forming a nozzle via a toner composition liquid, and as a result, it was confirmed that it might be possible to obtain sufficient vibration due to such a configuration, but, on the other hand, this configuration encountered a new problem such that irregularity of vibration of a thin film forming a nozzle might be caused by means of resonance of a toner composition liquid and irregularity of a liquid drop size (ultimately, a toner size) might be caused.

SUMMARY OF THE INVENTION

According to one aspect of the present invention, there is provided a method of manufacturing a toner, wherein a liquid drop forming part including a storage part configured to store a toner composition liquid in which a toner composition including at least a resin and a coloring agent is dispersed or dissolved, a thin film on which a nozzle facing the storage part is formed, and a vibration generating part configured to vibrate the thin film via the toner composition liquid in the storage part are used to conduct a periodic liquid drop forming process configured to form and eject a liquid drop of the toner composition liquid from the plural nozzles periodically and a particle forming process configured to solidify the ejected liquid drop of the toner composition liquid, wherein plural storage chambers partitioned by a partition wall(s) are formed in the storage part and a width of each storage chamber in a direction of arrangement of the plural storage chambers and a width of each storage chamber in a direction orthogonal to the direction of arrangement of the storage chambers are formed to be one-half or less of a wavelength λ of a sonic wave generated in the storage part.

According to another aspect of the present invention, there is provided a device of manufacturing a toner, wherein it is provided with a periodic liquid drop forming part which uses a liquid drop forming part including a storage part configured to store a toner composition liquid in which a toner composition including at least a resin and a coloring agent is dispersed or dissolved, a thin film on which a nozzle facing the storage part is formed, and a vibration generating part configured to vibrate the thin film via the toner composition liquid in the storage part, to form and eject a liquid drop of the toner composition liquid from the plural nozzles periodically, wherein plural storage chambers partitioned by a partition wall(s) are formed in the storage part and a width of each storage chamber in a direction of arrangement of the plural storage chambers and a width of each storage chamber in a direction orthogonal to the direction of arrangement of the storage chambers are formed to be one-half or less of a wavelength λ of a sonic wave generated in the storage part, and a particle forming part configured to solidify the ejected liquid drop of the toner composition liquid.

According to another aspect of the present invention, there is provided a toner, wherein the toner is manufactured by a method of manufacturing a toner, wherein a liquid drop forming part including a storage part configured to store a toner composition liquid in which a toner composition including at least a resin and a coloring agent is dispersed or dissolved, a thin film on which a nozzle facing the storage part is formed, and a vibration generating part configured to vibrate the thin film via the toner composition liquid in the storage part are used to conduct a periodic liquid drop forming process configured to form and eject a liquid drop of the toner composition liquid from the plural nozzles periodically and a particle forming process configured to solidify the ejected liquid drop of the toner composition liquid, wherein plural storage chambers partitioned by a partition wall(s) are formed in the storage part and a width of each storage chamber in a direction of arrangement of the plural storage chambers and a width of each storage chamber in a direction orthogonal to the direction of arrangement of the storage chambers are formed to be one-half or less of a wavelength λ of a sonic wave generated in the storage part.

DETAILED DESCRIPTION OF THE PREFERRED EMBODIMENTS

Figure 1:
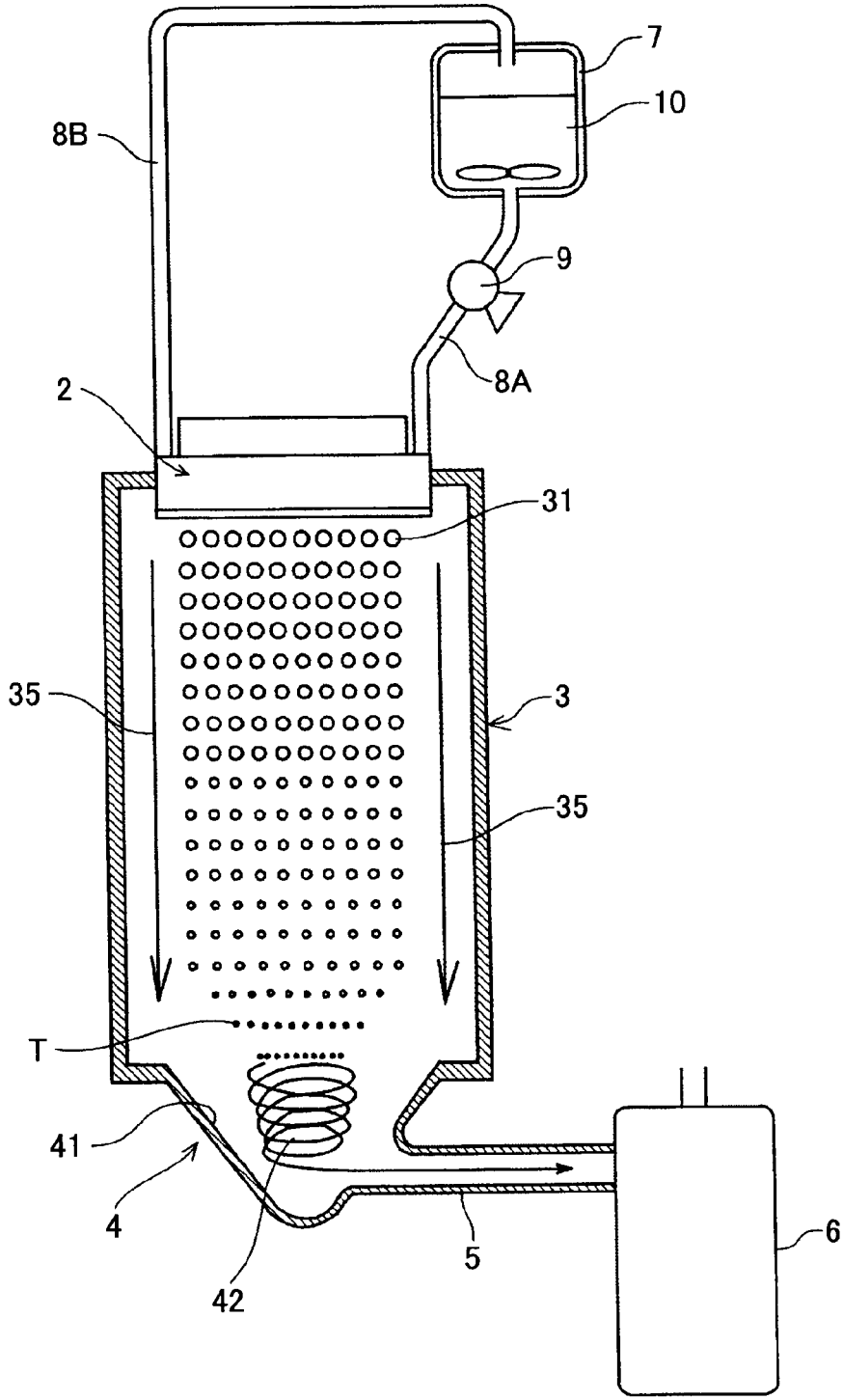
FIG. 1 is a schematic configuration diagram of one example of a device of manufacturing a toner according to a specific embodiment of the present invention to implement a method of manufacturing a toner according to a specific embodiment of the present invention.

At least one illustrative embodiment of the present invention relates to a method of manufacturing a toner, a device of manufacturing a toner, and a toner. In particular, at least one illustrative embodiment of the present invention relates to a method of manufacturing a toner and device of manufacturing a toner in which a toner is manufactured by a jet granulation method and a toner manufactured by a jet granulation method.

At least one illustrative embodiment of the present invention may have been made while taking a problem as described above into consideration and may aim at improving a production efficiency of a toner, and furthermore, obtaining a toner excellent in a characteristic value such as its fluidity or charging characteristic and also having a small dispersion.

In order to solve the problem as described above, a method of manufacturing a toner according to an illustrative embodiment of the present invention may be configured such that liquid drop forming means having a storage part for storing a toner composition liquid in which a toner composition containing at least a resin and a coloring agent is dispersed or dissolved, a thin film on which a nozzle facing the storage part is formed, and vibration generating means for vibrating the thin film via the toner composition liquid in the storage part, wherein plural storage chambers partitioned by a partition wall(s) are formed in the storage part and its width in a direction of arrangement of the plural storage chambers and its width in a direction orthogonal to the direction of arrangement of the storage chambers are formed to be one-half or less of a wavelength λ of a sonic wave generated in the storage part, are used to conduct a periodic liquid drop forming process for periodically forming and ejecting a liquid drop of the toner composition liquid from the plural nozzles and a particle forming process for solidifying the ejected liquid drop of the toner composition liquid.

Herein, it may be possible to provide a configuration such that the storage part is provided with a common flow channel communicating with the plural storage chambers and the common flow channel is communicated with a liquid supplying pipe to which the toner composition liquid is supplied from an outside and a liquid draining pipe for draining the toner composition liquid.

Also, it may be possible to provide a configuration such that the thin film of the liquid drop forming means is vibrated at a vibration frequency of 20 kHz or more and 2.0 MHz or less.

Also, it may be possible to provide a configuration such that 1000 to 10000 nozzles corresponding to one partitioned liquid chamber area are formed on the thin film.

Also, it may be possible to provide a configuration such that the liquid drop is dried in a solvent removing part for removing a solvent of a liquid drop of the toner composition liquid in the particle forming process.

Also, it may be possible to provide a configuration such that drying is conducted in a cooling part for cooling a liquid drop of the toner composition liquid in the particle forming process.

Also, it may be possible to provide a configuration such that a liquid drop of the toner composition liquid is delivered and its solvent is removed by means of a dry gas flowing in a direction identical to an ejection direction of a liquid drop of the toner composition liquid in the particle forming process.

In this case, it may be possible to provide a configuration such that the dry gas is air or nitrogen gas.

A device of manufacturing a toner according to an illustrative embodiment of the present invention is configured such that it is provided with periodic liquid drop forming means which uses liquid drop forming means having a storage part for storing a toner composition liquid in which a toner composition containing at least a resin and a coloring agent is dispersed or dissolved, a thin film on which a nozzle facing the storage part is formed, and a vibration generating means for vibrating the thin film via the toner composition liquid in the storage part, wherein plural storage chambers partitioned by a partition wall(s) are formed in the storage part and its width in a direction of arrangement of the plural storage chambers and its width in a direction orthogonal to the direction of arrangement of the storage chambers are formed to be one-half or less of a wavelength λ of a sonic wave generated in the storage part, to periodically form and eject a liquid drop of the toner composition liquid from the plural nozzles, and particle forming means for solidifying the ejected liquid drop of the toner composition liquid.

Herein, it may be possible to provide a configuration such that the storage part is provided with a common flow channel communicating with the plural storage chambers and the common flow channel is communicated with a liquid supplying pipe to which the toner composition liquid is supplied from an outside and a liquid draining pipe for draining the toner composition liquid.

Also, it may be possible to provide a configuration such that the thin film of the liquid drop forming means is vibrated at a vibration frequency of 20 kHz or more and 2.0 MHz or less.

Also, it may be possible to provide a configuration such that 1000 to 10000 nozzles corresponding to one partitioned liquid chamber area are formed on the thin film.

Also, it may be possible to provide a configuration such that the particle forming means are provided with a solvent removing part for removing and drying a solvent of a liquid drop of the toner composition liquid.

Also, it may be possible to provide a configuration such that the particle forming means are provided with a cooling part for cooling and drying a liquid drop of the toner composition liquid.

Also, it may be possible to provide a configuration such that the particle forming means are provided with means for delivering a liquid drop of the toner composition liquid and removing its solvent by means of a dry gas flowing in a direction identical to an ejection direction of a liquid drop of the toner composition liquid.

In this case, it may be possible to provide a configuration such that the dry gas is air or nitrogen gas.

A toner according to an illustrative embodiment of the present invention is manufactured by the method of manufacturing a toner according to an illustrative embodiment of the present invention.

Herein, it may be preferable that its particle size distribution (weight average particle diameter/number average particle diameter) is in a range of 1.00-1.15. Also, it may be preferable that its weight average particle diameter is 1-20 μm.

Due to a method of manufacturing a toner and/or a device of manufacturing a toner according to an illustrative embodiment of the present invention, it may be possible to form a liquid drop of a toner composition liquid efficiently while its deviation is reduced, and to improve a production efficiency of a toner, and furthermore, it may be possible to obtain a toner being excellent in characteristic values such as its fluidity, charging characteristic, and the like, and having a small deviation, because there may be a configuration such that liquid drop forming means having a storage part for storing a toner composition liquid in which a toner composition containing at least a resin and a coloring agent is dispersed or dissolved, a thin film on which a nozzle facing the storage part is formed, and vibration generating means for vibrating the thin film via the toner composition liquid in the storage part, wherein plural storage chambers partitioned by a partition wall(s) are formed in the storage part and its width in a direction of arrangement of the plural storage chambers and its width in a direction orthogonal to the direction of arrangement of the storage chambers are formed to be one-half or less of a wavelength λ of a sonic wave generated in the storage part, are used to periodically form and eject a liquid drop of the toner composition liquid from the plural nozzles.

Due to a toner according to an illustrative embodiment of the present invention, it may be possible to obtain a toner with a small variable range depending on a particle in many characteristic values required for a toner such as its fluidity and charging characteristic, because it is manufactured by a method of manufacturing a toner according to an illustrative embodiment of the present invention.

Next, the best mode for carrying out an illustrative embodiment of the present invention will be described with reference to the accompanying drawings.

First, one example of a device of manufacturing a toner according to a specific embodiment of the present invention to implement a method of manufacturing a toner according to a specific embodiment of the present invention will be described with reference to a schematic configuration diagram of FIG. 1.

This toner manufacturing device 1 includes a liquid drop jetting unit 2 as liquid drop forming means for forming and ejecting a liquid drop of a toner composition liquid containing at least a resin and a coloring agent, particle forming means 3 on which the liquid drop jetting unit 2 is arranged, as particle forming means for solidifying a liquid drop 30 of the toner composition liquid from which a liquid drop to be ejected from the liquid drop jetting unit 2 is formed, so as to form a toner particle T, toner collecting means (a toner collecting part) 4 for correcting the toner particle T formed by the particle forming means (a solvent removing part) 3, wherein the toner particle T collected by the toner collecting means is transferred through a tube 5, a toner storage part (toner containing part) 6 as toner storage means for storing the transferred toner particle T, a raw material containing part 7 for containing the toner composition liquid 10, a pipe line (liquid supplying tube) 8A and pipe line (air bubble emission tube for air bubble emission or tube for liquid circulation) 8B for liquid-sending the toner composition liquid 10 from the raw material containing part 7 to the liquid drop jetting unit 2, and a pump 9 for pumping and supplying the toner composition liquid 10 from the raw material containing part 7 through the liquid supplying tube 8A to the liquid drop jetting unit 2 in operation or the like. Additionally, a solution or liquid dispersion in which a toner composition containing at least a resin and a coloring agent is dissolved or dispersed in a solvent is used for the toner composition liquid 10 herein.

Thus, a circulation system is configured such that the toner composition liquid 10 from the raw material containing part 7 is spontaneously supplied to the liquid drop jetting unit 2 by means of a liquid drop forming phenomenon caused by the liquid drop jetting unit 2 and returned from the liquid drop ejecting unit 2. Herein, the configuration is to conduct liquid supply using the pump 9 supplementarily as described above at the start of a device operation or the like.

Figure 2:
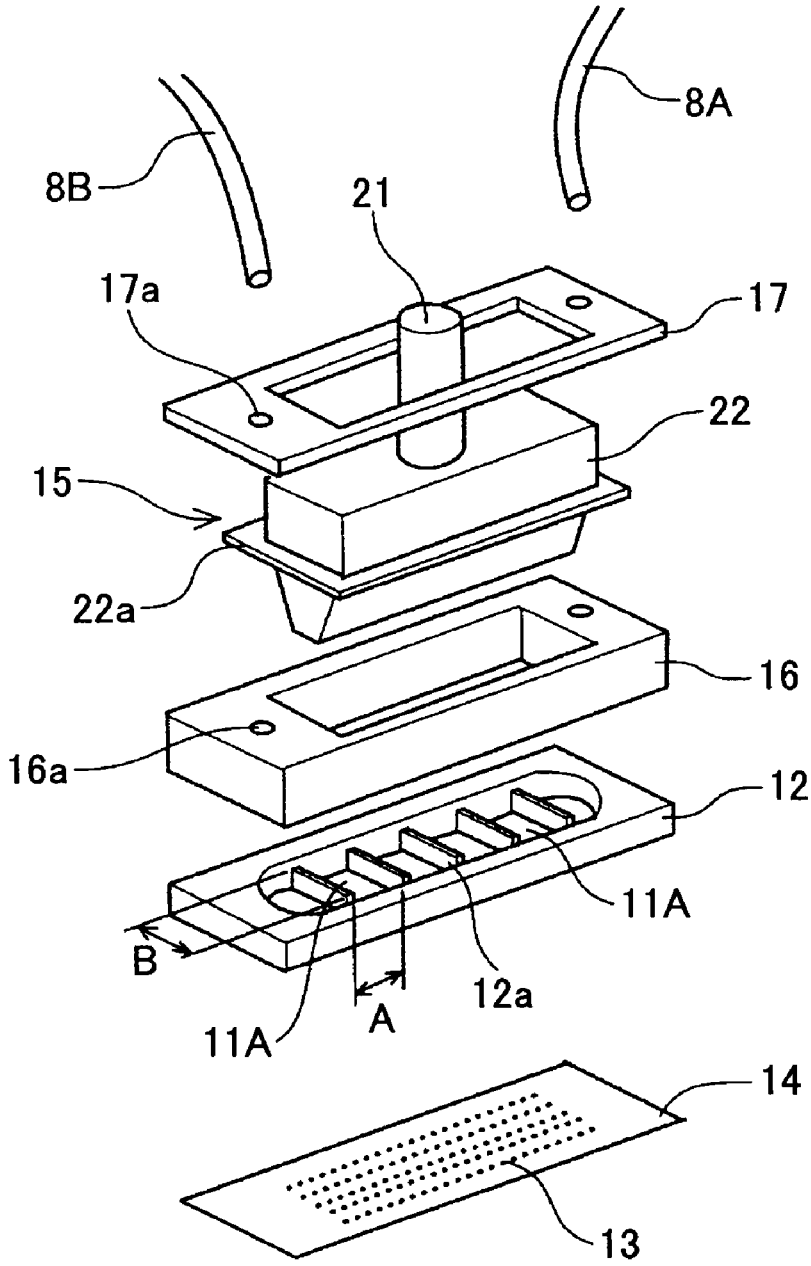
FIG. 2 is an exploded perspective illustration diagram illustrating a first example of a liquid drop jetting unit of the device.
Figure 3:
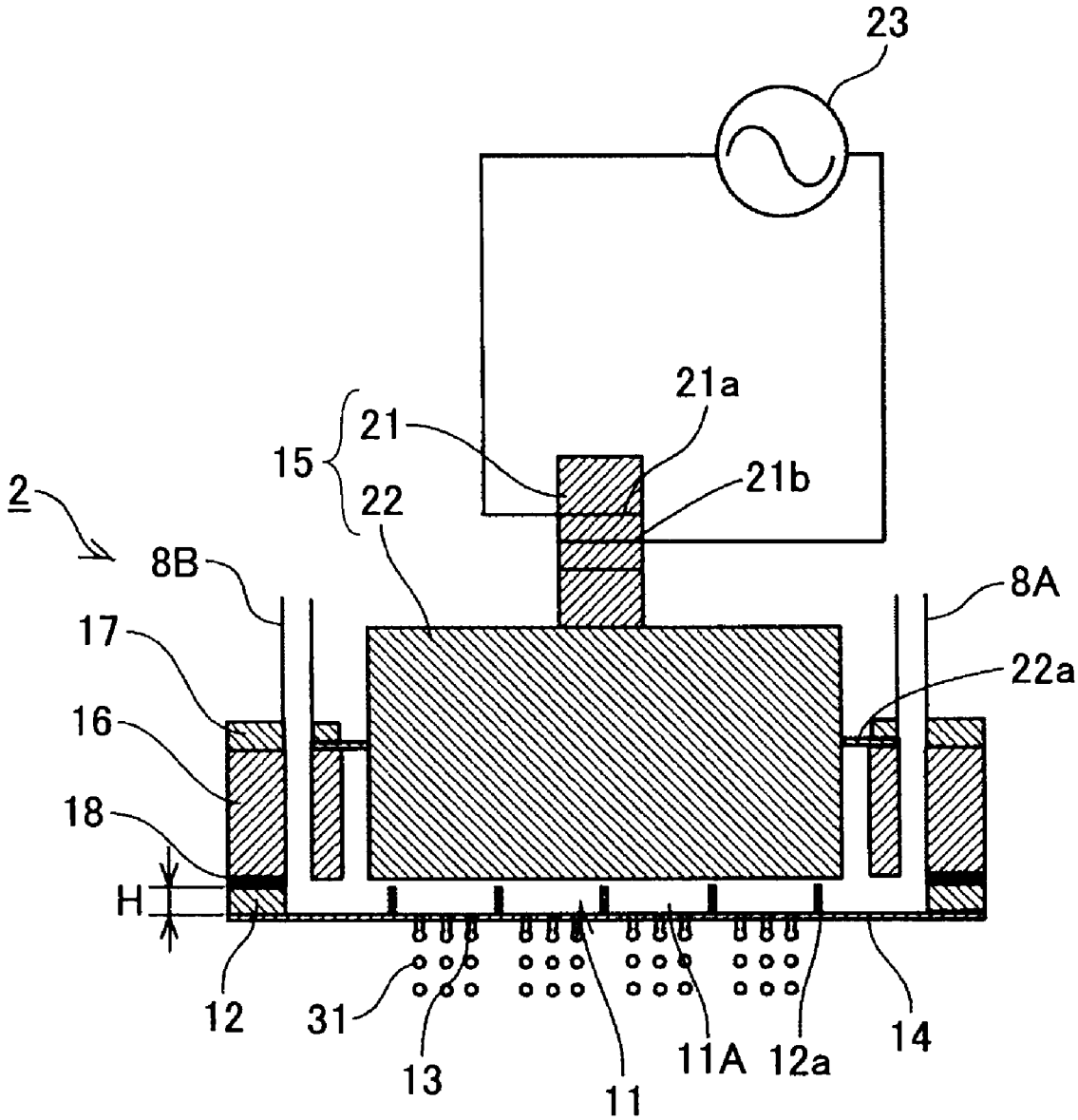
FIG. 3 is a schematic cross-section illustration diagram of the same.
Figure 4:
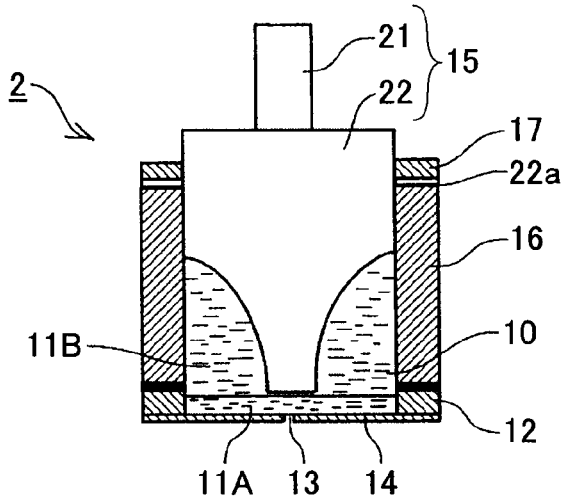
FIG. 4 is a schematic cross-section illustration diagram of the same in a direction orthogonal to that of FIG. 3.

Next, a first example of the liquid drop jetting unit 2 will be described with reference to FIG. 2 to FIG. 4. Additionally, FIG. 2 is an exploded perspective illustration diagram of the liquid drop jetting unit 2, FIG. 3 is a schematic cross-section illustration diagram of the unit, and FIG. 4 is also its schematic cross-section illustration diagram in a direction orthogonal to that of FIG. 3.

This liquid drop jetting unit 2 includes a storage part forming member (flow channel member) 12 composing a storage part (liquid chamber) 11 for storing the toner composition liquid 10, a thin film 14 for which a nozzle 13 facing the storage part 11 is formed, and vibration means 15 including vibration generating means for vibrating the thin film 14 via the toner composition liquid 10 in the storage part 11. The storage part (also referred to as a "liquid storage part") 11 composed of the storage part forming member (flow channel member) 12 has plural storage chambers (also referred to as a "liquid storage region") 11A partitioned by a partition wall(s) 12*a*.

A frame member 16 and a press member 17 for holding the vibration means 15 are also included wherein the storage part forming member 12 is fixed on the frame member 16 via a vibration isolating member 18 and the vibration means 15 are fixed and held by interposing a node part 22*a* with a small vibration amplitude of the vibration means 15 as described below between the frame member 16 and the press member 17.

Each of the liquid supplying tube 8A and air bubble emission tube for air bubble emission (or tube for liquid circulation) 8B used for liquid supply and liquid circulation which are inserted into and connected to holes 16*a* of the frame member 16 and holes 17*a* of the press member 17 is also connected to at least one part and formed between the storage part forming member 12 and frame member 16 and the wall face of a vibration amplification member 22 of the vibration means 15 as described below, wherein the toner composition liquid 10 is supplied to a common flow channel 11B communicating with each storage chamber 11A and the toner composition liquid 10 is supplied from the common flow channel 11B to each storage chamber 11A.

The thin film 14 is joined with and fixed to the storage part forming member 12 by means of a resin binder material that is insoluble in the toner composition liquid 10. For the material of this thin film 14, it may be possible to use a metal that is comparatively easy to form a hole, such as nickel or a stainless steel, or a member material to be generally used for a ceramic for construction, such as alumina, silicon carbide, or aluminum nitride.

Although the shape of a nozzle 13 is not particularly limited and may be an appropriately selected shape, it is preferable that, for example, the thickness of the thin film 14 is 10-500 μm and the aperture diameter of the nozzle 13 is 3-35 μm, from the viewpoint that fine liquid drops having a uniform particle diameter are generated when a liquid drop of the toner composition liquid 10 is jetted from the nozzle 13. Herein, the aperture diameter of the above-mentioned nozzle 13 means a diameter for a circle and means a minor axis for an ellipse.

For the number of the plural nozzles 13 arranged for one storage chamber 11A, it may also be possible to arrange 1,000 to 10,000 nozzles according to need. More preferably, 1,000 to 3,000 nozzles may be arranged from the viewpoint of an operation performance.

The vibration means 15 are composed of vibration generating means 21 for generating vibration and vibration amplifying means 22 for amplifying vibration generated by the vibration generating means 21, wherein a driving voltage (driving signal) with a predetermined frequency from a driving circuit (driving signal generating source) 23 is applied between electrodes 21*a* and 21*b* of the vibration generating means 21 so as to excite vibration of the vibration generating means 21 and this vibration is amplified by the vibration amplifying means 22, whereby a vibration surface (a thin-film-opposing surface of the vibration amplifying means 22) 15*a* arranged parallel to the thin film 14 is vibrated periodically and a periodic pressure vibration of the toner composition liquid 10 in each storage chamber 11A of the storage part 11 is caused by means of vibration of the vibration surface 15*a* so as to vibrate the thin film 14. Herein, the vibration means 15 are fixed and held by interposing the part 22*a* of the vibration amplifying means 22 between the frame member 16 and the press member 17 as described above.

Figure 5:
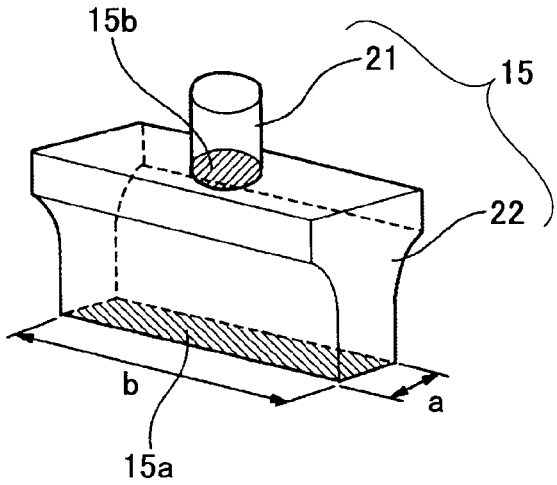
FIG. 5 is perspective illustration diagram of the same which contributes to illustration of vibrating means.

For the vibration means 15, the surface area of the vibration surface 15*a* that is a surface on the opposite side of a coupling surface 15*b* of the vibration amplifying means 22 is configured to be greater than the surface area of the coupling surface 15*b* for coupling the vibration amplifying means 22 to with vibration generating means 21, as illustrated in FIG. 5. Furthermore, the vibration surface 15*a* has a rectangular shape (is an "oblong shape" herein). In this case, the higher the ratio of a long side "b" to a short side "a" (long side "b"/short side "a") of the vibration surface 15*a* is, the more the surface area of vibration increases. Accordingly, its formation in the relationship of (long side "b"/short side "a")>2.0 is preferable from the viewpoint of its productivity.

The vibration generating means 21 may be composed of, for example, a piezoelectric body, wherein it may be possible to provide, for example, piezoelectric ceramics such as lead titanate zirconate (PZT) for the piezoelectric body, but its deformation is small generally and accordingly it is preferable to use a laminated piezoelectric body. In addition, it may be possible to provide piezoelectric polymers such as polyvinilidene fluoride (PVDF), single crystals such as quartz, LiNbO3, $LiTaO_3$, and $KNbO_3$, and the like.

The vibration generating means 21 are not particularly limited as long as it may be possible to apply exact longitudinal vibration at a constant frequency to the toner composition liquid 10 in the storage chamber 11A of the storage part 11, and may be selected and used appropriately, and it is preferable to use a piezoelectric body for the vibration generating means 21 in order to excite vibration of a large area vibration surface 15*a* at a low voltage. Any piezoelectric body has a function of converting electric energy into mechanical energy.

For the vibration generating means 21, it is also more preferable to use a bolted Langevin-type transducer with a particularly high strength. This bolted Langevin-type transducer may not be broken at the time of excitation of vibration with a high amplitude, because a piezoelectric body is connected mechanically.

For the vibration amplifying means 22 coupled with the vibration generating means 21, it may be possible to use, for example, a horn-type vibration amplifier. Such a horn-type transducer may contribute to attainment of its long life as a production device because it may be possible to amplify a vibrational amplitude of the vibration generating means 21 such as a piezoelectric element by means of a horn as the vibration amplifying means 22 and accordingly only an small vibration is required for the vibration generating means 21 for generating a mechanical vibration so as to reduce a mechanical load.

Figure 6:
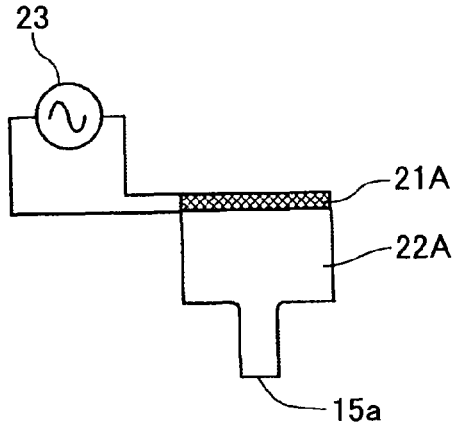
FIG. 6 is a schematic illustration diagram illustrating an example of a step-type-horn-type transducer which constitutes vibration generating means of the liquid drop jetting unit.
Figure 7:
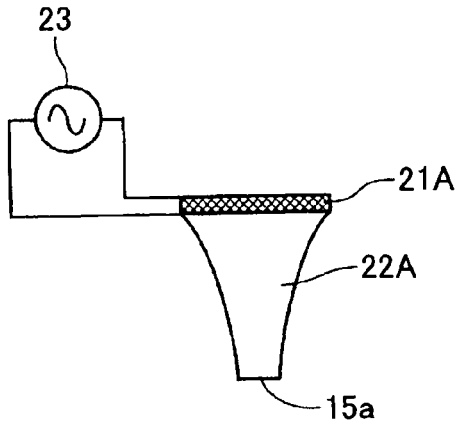
FIG. 7 is a schematic illustration diagram illustrating an example of an exponential-type-horn-type transducer which constitutes vibration generating means of the liquid drop jetting unit.
Figure 8:
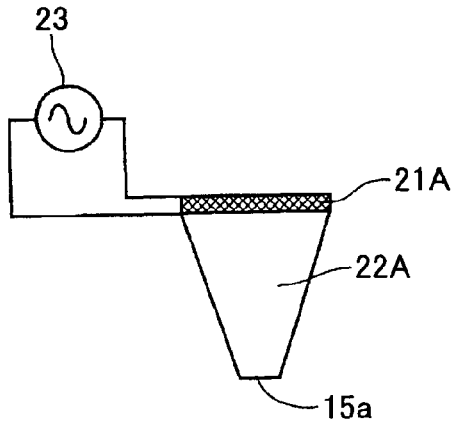
FIG. 8 is a schematic illustration diagram illustrating an example of conical-type-horn-type transducer which constitutes vibration generating means of the liquid drop jetting unit.

Herein, the horn-type transducer may have a publicly-known and typical horn shape and it may be possible to provide, for example, a step-type one as illustrated in FIG. 6, an exponential-type one as illustrated in FIG. 7, a conical-type one as illustrated in FIG. 8, and the like. These horn-type transducers are designed such that a piezoelectric body 21A is arranged on a larger area surface of a horn 22A, wherein the piezoelectric body 21A utilizes longitudinal vibration so as to induce efficient vibration of the horn 22A and a smaller area surface of the horn 22A is a vibration surface 15*a* wherein this vibration surface 15*a* is a maximum vibration surface.

For the storage part 11 for storing the toner composition liquid 10 between the thin film 14 and the vibration generating means 15, plural storage chambers 11A partitioned by a partition wall(s) 12*a* are formed as described above. For the storage part forming member 12 composing the storage part 11, a material that is insoluble in the toner composition liquid 10 and does not cause modification of a property of the toner composition liquid 10 to be ejected may be used among general materials such as metals, ceramics and plastics.

Herein, the widths A of the plural storage chambers 11A of the storage part 11 in the direction of storage chamber arrangement, their widths B in the direction orthogonal to the storage chamber arrangement, and their depths H (see FIG. 2) are defined by the formula (1) and formula (2) as described below, and the widths A and B of one storage chamber 11A are provided to be one-half or less of the wavelength λ of an acoustic wave generated in the storage part 11.

Figure 9:
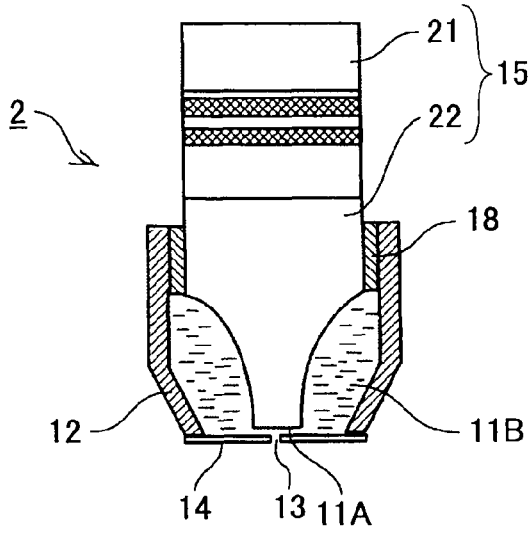
FIG. 9 is a schematic cross-section illustration diagram contributing to illustration of a second example of a liquid drop jetting unit of the device for manufacturing a toner.

Next, a second example of the liquid drop jetting unit 2 will be described with reference to FIG. 9. Herein, FIG. 9 is a schematic cross-section illustration diagram of the liquid drop jetting unit.

Herein, a storage chamber forming member 12 is formed into a shape surrounding vibration amplifying means 22 of vibration means 15 and the storage chamber forming member 12 is fixed onto the vibration amplifying means 22 by interposing vibration isolating means 18 so that a common flow channel is formed between the storage chamber forming member 12 and the vibration amplifying means 22 of the vibration means 15. Additionally, the others are configurations similar to those of the first example, wherein detailed illustrations of a storage chamber 11 and the like are omitted.

Next, the mechanism of liquid drop formation in the liquid drop jetting unit 2 as liquid drop forming means will be described with reference to FIG. 10A and FIG. 10B. Additionally, magnetic excitation is conducted by the liquid drop jetting unit 2 of the above-mentioned second example herein.

Figure 10A:
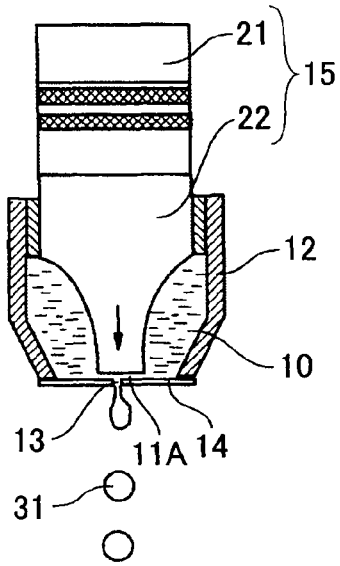
FIG. 10A and FIG. 10B are schematic illustration diagrams of a thin film which contribute to illustration of the operation principle of liquid drop formation by a liquid drop jetting unit.
Figure 10B:
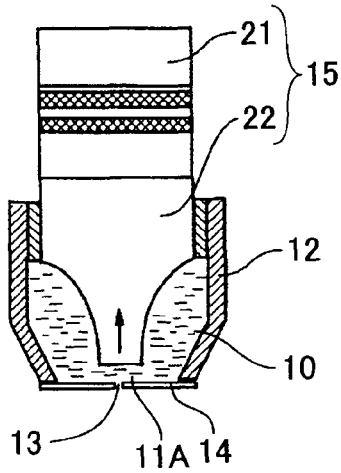
Figure 11:
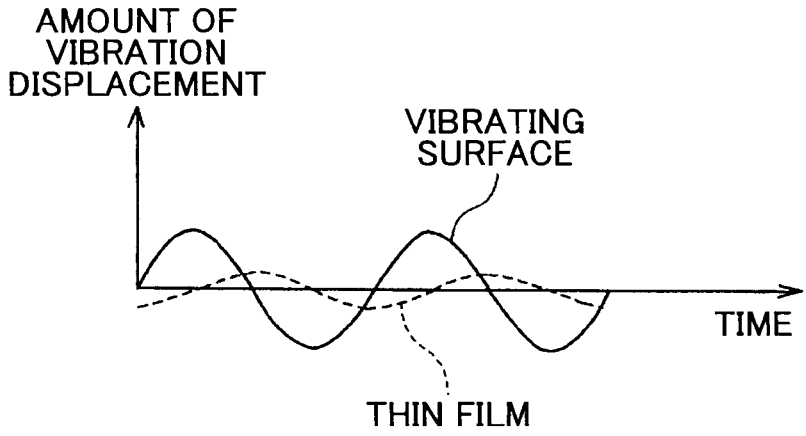
FIG. 11 is an illustration diagram contributing to illustration of the amount of vibration displacement of the same.

A vibration surface 15*a* that is a leading end surface of the vibration amplifying means 22 by driving vibration generating means 21 of the vibration means 15 stretches between the state of expansion to the side of a thin film 14 as illustrated in FIG. 10A and the state of withdrawal from the side of the thin film 14 as illustrated in FIG. 10B so that the vibration surface 15*a* vibrates as indicated by a solid line in FIG. 11. Vibration generated on the vibration surface 15*a* of the vibration mean 15 is transmitted to the toner composition liquid 10 in the storage part 11 and arrives at the thin film 14 as an acoustic wave so that the toner composition liquid 10 is in its pressurized state in plural nozzles 13 provided on the thin film 14 and ejected to the outside.

Herein, the acoustic wave having transmitted through the storage part 11 also acts on the above-mentioned thin film 14, and accordingly, the thin film 14 is also vibrated with a phase delay from that of the vibration means 15, as indicated by a broken line in FIG. 11. Due to this action of vibration, a lot of dispersed fine particles contained in the toner composition liquid float in the storage part 11 without precipitating onto the surface of the thin film 14 at the side of the storage part 11, and accordingly, it may be possible to continue to form a liquid drop from the toner composition liquid 10 and jet it stably.

Furthermore, when the thin film 14 is composed of a rigid member, vibration of the thin film 14 is in a relatively flat and uniform vibration mode as indicated by a broken line in FIG. 11 and it may be possible to arrange nozzles 13 over the whole area of such a relatively flat vibration area whereby it may be possible to considerably increase the amount of liquid drops of toner composition liquid 10 formed for a predetermined time period.

Next, the acoustic pressure distribution of liquid in the storage part 11 will be described. First, the wavelength λ of an acoustic wave generated in the storage part 11 is represented by the following formula (1):

$$\lambda = \frac{C}{f}, \tag{1}$$

wherein C is a sound velocity in the toner composition liquid and f is an excitation frequency applied for the vibration generating means 21. Then, the acoustic pressure distribution viewed from a direction of incidence on the inside of a pipe with a rectangular cross-section is generally represented by the formula (2):

$$\left[\frac{\lambda}{2}\frac{A}{m}\right] + \left[\frac{\lambda}{2}\frac{A}{n}\right], \tag{2}$$

wherein λ is a wavelength, each of "A" and "B" is the length of one side of the rectangular cross-section, and "m" and "n" are integers.

For this reason, it is possible to understand that a standing wave is generated when the widths of two sides of a totally rectangular shape of the storage part are integral multiples of a half wavelength. When a liquid drop of a toner composition liquid stored in such a storage part is formed and jetted from a nozzle and a considerable variation occurs in an ultrasonic wave applied to the toner composition liquid, that is, its acoustic pressure, the size of a formed liquid drop varies depending on the position of a jetting nozzle. Hence, a nozzle 13 should not be arranged on a part in which an inappropriate acoustic pressure may occur.

Consequently, the storage part 11 is partitioned by a partition wall(s) 12*a* into plural storage chambers 11A, which are configured such that the width "A" of one storage chamber 11A in a direction of arrangement of the storage chambers and its width "B" in a direction orthogonal to the direction of arrangement of the storage chambers are equal to a half or less of the wavelength λ of an acoustic wave generated in the storage part 11, in a specific embodiment of the present invention. Thereby, no acoustic pressure distribution is provided and no variation of drops is provided, so that it may be possible to arrange more nozzles 13 on the thin film 14.

As illustrated in FIG. 1, a liquid drop jetting unit 2 configured as described above is located on a top surface portion of particle forming means 3 and held by a supporting member that is attached to the frame member 16 (in the case of the first example) or the storage part forming member 12 (in the case of the second example) is not illustrated in the figure. Additionally, although illustration is herein provided for an example of arrangement of the liquid drop jetting unit 2 on a top surface portion of the particle forming means 3, it may also be possible to provide a configuration such that the liquid drop jetting unit 2 is located on a side wall or bottom portion of a drying part which is one of the particle forming means 3.

Figure 12:
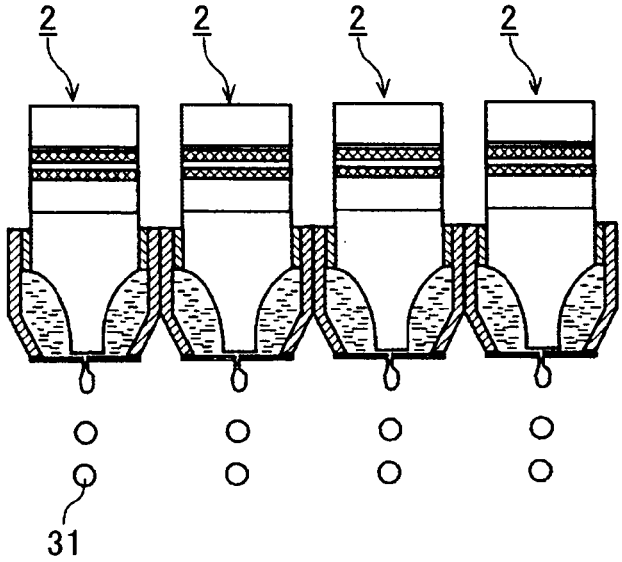
FIG. 12 is an illustration diagram contributing to illustration of an example in which the plural liquid drop jetting units of FIG. 9 are arranged.

Furthermore, although an illustration is provided for an example of attachment of only one liquid drop jetting unit 2 to the particle forming means 3 in the above descriptions, it is preferable to arrange preferably plural liquid drop jetting units 2 in a line on a top portion of the particle forming means 3 (drying tower) as illustrated in FIG. 12 from the viewpoint of productivity improvement, and the number of them is preferably in a range of 100 to 1,000 from the viewpoint of their controllability. In this case, each storage part 11 of the liquid drop jetting unit 2 communicates with the raw material containing part (common liquid reservoir) 7 via the pipe line 8 and is configured such that the toner composition liquid 10 is supplied thereto. It may also be possible to provide a configuration for spontaneously supplying the toner composition liquid 10 together with liquid drop formation and it may also be possible to provide a configuration for conducting liquid circulation using a pump 9 supplementally at the time of a device operation or the like.

Next, a particle forming part 3 for solidifying a liquid drop 30 of the toner composition liquid 10 so as to form a toner particle "T" will be described by going back to FIG. 1. Herein, a toner particle "T" is formed by drying and solidifying a liquid drop 20, because a solution or liquid dispersion in which a toner composition containing at least a resin and a coloring agent is dissolved or dispersed in a solvent is used for the toner composition liquid 10 as described above. That is, in this specific embodiment, the particle forming means 3 are solvent removing part for drying and removing the solvent of a liquid drop 20 so as to form a toner particle "T" (the particle forming means 3 will also be referred to as a "solvent removing part" or "drying part" below).

Specifically, the particle forming means 3 deliver liquid drops 20 ejected from the plural nozzles 13 of the liquid drop jetting unit 2 by means of a gas (dried gas) 35 flowing in the same direction as the traveling direction of those liquid drops 20 whereby the solvent of a liquid drop 31 is removed so as to form a toner particle "T". Additionally, the dried gas 35 means a gas on the condition that its dew-point temperature is −10° C. or lower at atmospheric pressure. It may be only necessary for the dried gas 35 to be a gas capable of drying a liquid drop 31, and it may be possible to use, for example, air, nitrogen, or the like.

Next, a toner collecting part 4 as toner collecting means for collecting toner particles "T" formed by the particle forming means 3 will be described.

This toner collecting part 4 is provided so as to be joined with particle forming means (drying part or solvent removing part) 3 at the downstream side of a particle traveling direction of the particle forming means 3 and has a taper surface 41 whose aperture diameter gradually decreases from its entrance side (the side of the liquid drop jetting unit 2) to its exit side. Then, for example, suction from the inside of the toner collecting part 4 is conducted by a suction pump that is not illustrated in the figure or the like, so that an air stream 42 that is a vortex flow directed to the downstream side is generated in the toner collecting part 4, and toner particles "T" are collected by means of the air stream 42. Thus, a centrifugal force is generated by the vortex flow (air stream 42) so as to collect the toner particles "T" whereby it may be possible to collect the toner particles "T" more certainly and transfer them to the toner storage part 6 at the downstream side.

The toner particles "T" collected by the toner collecting part 4 are directly transferred to and stored in the toner storage part 6 through tube 5 by means of the vortex flow (air stream 42). In this case, when the toner collecting part 4, the tube 5, and the toner storage part 6 are formed from an electrically conductive material(s), it is preferable that these are grounded (or connected to ground). Additionally, it is preferable that the whole of this manufacturing device is in accordance with an explosion-proof specification. Furthermore, it may also be possible to provide a configuration for pumping the toner particles "T" from the toner collecting part 4 to the toner storage part 6 or suctioning the toner particles "T" from the side of the toner storage part 6.

Next, an overview of a method of manufacturing a toner according to a specific embodiment of the present invention due to such a configured toner manufacturing device 1 will be described below.

As described above, vibration of the vibration generating means 21 is caused by applying a driving signal with a predetermined driving frequency to the vibration generating means 21 of the vibration means 15 composing the liquid drop forming means on the condition that the toner composition liquid 10 in which a toner composition containing at least a resin and a coloring agent is dispersed or dissolved is supplied to the storage part 11 of the liquid drop jetting unit 2, and this vibration is amplified by the vibration amplifying means 22 so as to excite vibration of the toner composition liquid 10 in each storage chamber 11A of the storage part 11.

Vibration of a vibration surface 14*a* of the vibration means 14 is propagated to the toner composition liquid 10 in each storage chamber 11A of the storage chamber 11 so as to case a periodic pressure variation whereby liquid drops of the toner composition liquid are formed periodically at the time of its pressurization and the liquid drop 31 is ejected from the plural nozzles 13 into the particle forming means 3 as a solvent removing part (see FIG. 1).

Then, the liquid drop 31 ejected into the particle forming means 3 is delivered by the dried gas 35 flowing to the same direction as the direction of traveling of the liquid drop 31 in the particle forming means 3 so as to remove its solvent and form a toner particle "T". The toner particles "T" formed by the particle forming means 3 are collected by means of the air stream 42 in the toner collecting part 4 at the downstream side and sent to and stored in the toner storage part 6 through the tube 5.

Because the liquid drop jetting unit 2 is thus provided with the plural nozzles 13 and accordingly plural or many liquid drops 31 of the toner composition liquid subjected to liquid drop formation are ejected simultaneously or continuously, the efficiency of production of a toner is improved drastically. In addition, the vibration means 15 are composed of the vibration generating means 21 for generating vibration and the vibration amplifying means 22 for amplifying the generated vibration, and accordingly, it may be possible to obtain a comparatively large amplitude at a low electric current. The plural nozzles 13 are arranged in an area of the thin film 14 whereby it may be possible to eject a lot of liquid drops 31 at once, and further, vibration of the thin film is excited so as to prevent dispersed fine particles present in the toner composition liquid 10 from depositing, whereby it may be possible to attain a stable and efficient toner manufacturing without causing clogging of the nozzles 13. Moreover, it was confirmed that it was possible to obtain a toner having a monodispersive particle size which had not existed.

Additionally, in this specific embodiment, while a solution or liquid dispersion in which a toner composition containing at least a resin and a coloring agent is dissolved or dispersed in a solvent is used for the toner composition liquid 10, an organic solvent contained in a liquid drop is evaporated to provide a dried gas in a solvent removing part (particle forming means) for means of solidifying a liquid drop and its shrinkage and solidification by means of drying is conducted to form a toner particle, but no limitation to it is made.

For example, it may also possible to provide a configuration such that a toner composition liquid is provided by melting and liquefying a toner composition in a heated storage part and is ejected or released as a liquid drop and subsequently the liquid drop is cooled and solidified so as to form a toner particle. It may also be possible to provide a configuration such that a toner composition liquid containing a thermosetting material is used and ejected as a liquid drop and subsequently heated and solidified by a curing reaction so as to form a toner particle.

Figure 13:
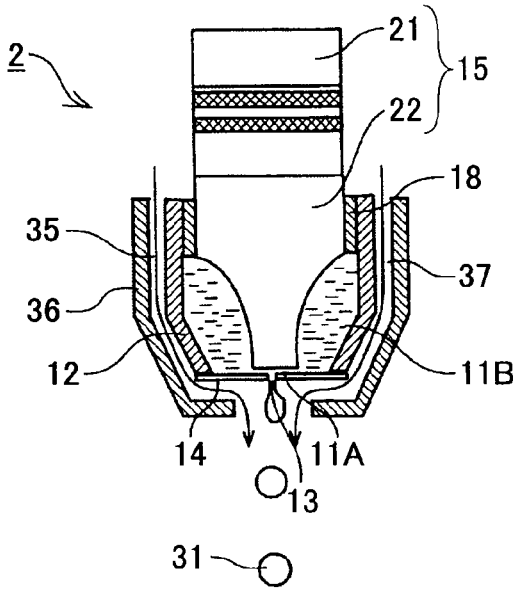
FIG. 13 is schematic cross-section illustration diagram contributing to illustration of a third example of a liquid drop jetting unit of the device for manufacturing a toner.

Next, a third example of the liquid drop jetting unit 2 will be described with reference to FIG. 13. Herein, FIG. 13 is a schematic cross-section illustration diagram of the liquid drop jetting unit.

For this liquid drop jetting unit 2, while a horn-type transducer is used for vibration generating means 21, a storage part forming member 12 for storing a toner composition liquid 10 is arranged to surround the vibration amplifying means 22 of a vibration means 15, and a storage chamber 11 is formed between a vibration surface 15*a* of the vibration amplifying means 22 of the vibration means 15 and a thin film 14, similarly to each example as described above. Furthermore, an air flow channel forming member 36 for forming an air flow channel 37 for flowing an air stream 35 is arranged at a predetermined distance from surrounding of the storage part forming member 12. Additionally, the other configurations are similar to those of each example as described above, wherein only one nozzle 13 of the thin film 14 is illustrated and a storage chamber 11 is also simplified and illustrated, for the purpose of simplifying illustration in the figure.

Figure 14:
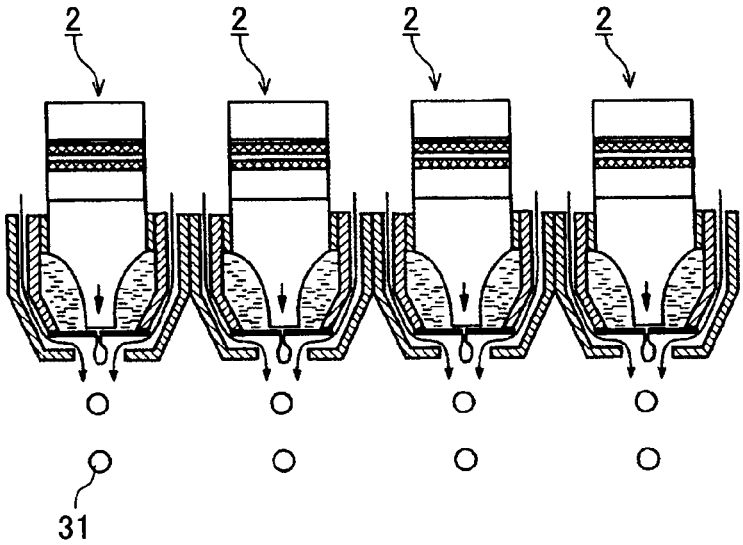
FIG. 14 is an illustration diagram contributing to illustration of an example in which the plural liquid drop jetting units of FIG. 13 are arranged.

In this case, it is also preferable to arrange plural liquid drop jetting units 2 having an air flow channel 37 as illustrated in FIG. 14, from the viewpoint of productivity. Then, 1,000-10,000 liquid drop jetting units 2 are preferably arranged in line on a top surface portion of a drying tower that is the particle forming means 3, from the viewpoint of controllability. Thereby, more increase of productivity is expected.

Thus, there is provided a configuration having a storage part for storing a toner composition liquid in which a toner composition containing at least a resin and a coloring agent is dispersed or dissolved, a thin film on which a nozzle facing the storage part is formed, and vibration generating means for vibrating the thin film by interposing the toner composition liquid in the storage part, wherein plural storage chambers partitioned by a partition wall(s) are formed in the storage part and liquid drops of the toner composition liquid are formed and ejected from plural nozzles periodically by using liquid drop forming means configured such that the width of the plural storage chambers in the arrangement direction of the storage chambers and their width in the direction orthogonal to the arrangement direction of thereof are a half or less of the wavelength $\lambda$ of an acoustic wave generated in the storage part, and accordingly, it may be possible to form liquid drops of the toner composition liquid while variation thereof is reduced efficiently, and it may be possible to obtain a toner having an improved toner production efficiency, being excellent in its characteristic values such as its fluidity and charging property, having a less variation, and having a monodispersive particle size that has not existed.

Next, toner materials (a toner composition liquid) usable for an embodiment of the present invention will be described.

For toner materials, it may be possible to use the completely same materials as those of a conventional toner for electrophotography. That is, it may be possible to manufacture a target toner particle by dissolving a toner binder such as a styrene-acryl-type resin, a polyester-type resin, a polyol-type resin, or an epoxy-type resin into each kind of organic solvent, dispersing a coloring agent, dispersing or dissolving a releasing agent, forming a fine liquid drop from it in accordance with the toner manufacturing method as described above, and drying and solidifying it. Furthermore, it may also be possible to obtain a target toner by forming a fine liquid drop from a liquid in which a kneaded material obtained by hot-melt-kneading the above-mentioned materials is once dissolved or dispersed in each kind of solvent in accordance with the above-mentioned toner manufacturing method and drying and solidifying it.

[Materials for Toner]

The above-mentioned materials for toner include at least a resin and a coloring agent and further include (an)other component(s) such as a carrier, a wax and/or the like, according to need.

[Resins]

For the above-mentioned resin, it may be possible to provide at least a binder resin.

The above-mentioned binder resin is not particularly limited and it may be possible to select and use a commonly used resin appropriately, wherein it may be possible to provide, for example, vinyl polymers of a styrene-type monomer, acryl-type monomer, methacryl-type monomer or the like, copolymers of these monomers or two or more kinds thereof, polyester-type polymers, polyol resins, phenol resins, silicone resins, polyurethane resins, polyamide resins, furan resins, epoxy resins, xylene resins, terpene resins, coumarone-indene resins, polycarbonate resins, petroleum-type resins, and the like.

For the styrene-type monomer, it may be possible to provide, for example, styrene and derivatives thereof, such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene, and the like.

For the acryl-type monomer, it may be possible to provide, for example, acrylic acid and esters thereof, such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl arylate, and phenyl acrylate, and the like.

For the methacryl-type monomer, it may be possible to provide, for example, methacrylic acid and esters thereof, such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate, and the like.

For examples of other monomers for forming the vinyl polymers and the copolymers, it may be possible to provide the following (1)-(18).

(1) monoolefins such as ethylene, propylene, butylene, and isobutylene;

(2) polyenes such as butadiene and isoprene;

(3) vinyl halides such as vinyl chloride, vinylidene chloride, vinyl bromide, and vinyl fluoride;

(4) vinyl esters such as vinyl acetate, vinyl propionate, and vinyl benzoate;

(5) vinyl ethers such as vinyl methyl ether, vinyl ethyl ether, and vinyl isobutyl ether;

(6) vinyl ketones such as vinyl methyl ketone, vinyl hexyl ketone, and methyl isopropenyl ketone;

(7) N-vinyl compounds such as N-vinylpyrrol, N-vinylcarbazole, N-vinylindole, and N-vinylpyrrolidone;

(8) vinylnaphthalenes;

(9) acrylic acid and methacrylic acid derivatives, and the like, such as acrylonitrile, methacrylonitrile, and acrylic amides;

(10) unsaturated dibasic acids such as maleic acid, citraconic acid, itaconic acid, alkenyl succinic acids, fumaric acid, and mesaconic acid;

(11) unsaturated dibasic acid anhydrides such as maleic acid anhydride, citraconic acid anhydride, itaconic acid anhydride, and alkenyl succinic acid anhydrides;

(12) monoesters of unsaturated dibasic acids such as maleic acid monomethylester, maleic acid monoethylester, maleic acid monobutylester, citraconic acid monomethylester, citraconic acid monoethylester, citraconic acid monobutylester, itaconic acid monomethylester, alkenylsuccinic acid monomethylesters, fumaric acid monomethylester, and mesaconic acid monomethylester;

(13) unsaturated dibasic acid esters such as dimethyl maleate and dimethyl fumarate;

(14) α,β-unsaturated acids such as crotonic acid and cinnamic acid;

(15) α,β-unsaturated acid anhydrides such as crotonic acid anhydride and cinnamic acid anhydride;

(16) monomers having a carboxyl group such as anhydrides of the α,β-unsaturated acid anhydrides and lower fatty acids, alkenylmalonic acids, alkenylglutaric acids, alkenyladipic acids, and acid anhydrides thereof and monoesters thereof;

(17) acryl acid and methacryl acid hydroxyalkylesters such as 2-hydroxyethyl acrylate, 2-hydroxyethyl methacrylates, and 2-hydroxypropyl methacrylates; and

(18) monomers having a hydroxyl group such as 4-(1-hydroxy-1-methyl butyl)styrene and 4-(1-hydroxy-1-methyl hexyl)styrene.

In a toner according to a specific embodiment of the present invention, it may be possible for the vinyl polymer or copolymer as a binder resin to have a cross-linking structure in which it is cross-linked by a cross-linking agent having two or more vinyl groups. For the cross-linking agent used in this case, it may be possible to provide, for example, divinylbenzene, divinylnaphthalene, and the like, for aromatic divinyl compounds. For diacrylate compounds which are linked by an alkyl chain, it may be possible to provide, for example, ethylene glycol diacrylate, 1,3-butylene glycols diacrylate, 1,4-butanediol diacrylate, 1,5-pentanediol diacrylate, 1,6-hexanediol diacrylate, neopentyl glycol diacrylate, these compounds whose acrylates have been replaced with methacrylates, and the like. For diacrylate compounds which are linked by alkyl chain containing an ether linkage, it may be possible to provide, for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, these compounds whose acrylates have been replaced with methacrylates, and the like.

In addition, it may also be possible to provide diacrylate compounds and dimethacrylate compounds which are linked by an aromatic group or a chain containing an ether linkage. For polyester-type diacrylates, it may be possible to provide, for example, commercial name MANDA (produced by NIPPON KAYAKU Co., Ltd.).

For multifunctional cross-linking agents, it may be possible to provide, pentaerythritol triacrylate, trimethylolethane triacrylate, trimethylolpropane triacrylate, tetramethylolmethane tetraacrylate, oligoester acrylates, and the above-described compounds whose acrylates have been replaced with methacrylates, triallyl cyanurate, and triallyl trimellitate.

For these cross-linking agents, 0.01-10 parts by mass of them per 100 parts by mass of other monomer components are preferably used, and 0.03-5 parts by mass of them are more preferable. Among these cross-linkable monomers, it may be possible to provide aromatic divinyl compounds (in particular, divinylbenzene) and diacrylate compounds which are bonded by a bonding chain containing an aromatic group and an ether linkage, preferably, in view of their fixation property and offset resistance property to a resin for toner. Among these, monomer combinations are preferable which may be able to provide a styrene-type copolymer or a styrene-acryl-type copolymer.

For polymerization initiators used for manufacturing a vinyl polymer or copolymer in a specific embodiment of the present invention, it may be possible to provide, for example, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimathyl-4'-methoxyvaleronitrile, 2,2'-azobis(2-methylpropane), ketone peroxides such as methyl ethyl ketone peroxide, acetylacetone peroxide, and cyclohexanone peroxide, 2,2-bis(tetrabutylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl) peroxycarbonate, acetylcyclohexylsulfonyl peroxide, tert-butyl peroxyacetate, tert-butyl peroxyisobutyrate, tert-butyl peroxy-2-ethyl hexanoate, tert-butyl peroxylaurate, tert-butyloxybenzoate, tetr-butyl peroxyisopropylcarbonate, di-tert-butyl peroxyisophthalate, tert-butyl peroxyallylcarbonate, isoamyl peroxy-2-ethylhexanoate, di-tert-butyl peroxyhexahydroterephthalate, tert-butyl peroxyazelate, and the like.

When the binder resin is a styrene-acryl-type resin, a resin in which at lease one peak is present in a region of molecular weight of 3,000-50,000 (converted number average molecular weight) and at least one peak is present in a region of a molecular weight of 100,000 or more with respect to a molecular weight distribution of a resin component soluble in tetrahydrofuran (THF) in a GPC is preferable in view of its fixation property, offset property and storage property. Furthermore, in regard to its THF soluble component(s), a binder resin in which a component with a molecular weight distribution of 100,000 or less is in 50-90% is preferable, a binder resin having a main peak in a region of a molecular weight of 5,000-30,000 is more preferable, and a binder resin having a main peal in a region of 5,000-20,000 is most preferable.

When the binder resin is a vinyl polymer such as a styrene-acryl-type resin or the like, its acid value is preferably 0.1 mgKOH/g-100 mgKOH/g, more preferably 0.1 mgKOH/g-70 mgKOH/g, and most preferably 0.1 mgKOH/g-50 mgKOH/g.

For monomers composing polyester-type polymers, it may be possible to provide the followings.

For dihydric alcohols, it may be possible to provide, for example, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained by polymerizing bisphenol A with a cyclic ether such as ethylene oxide or propylene oxide, and the like. In order to cross-link a polyester resin, it is preferable to use tri- or more-hydric alcohols in combination.

For the above-mentioned tri- or more-hydric or polyhydric alcohols, it may be possible to provide sorbitol, 1,2,3,6-hexaneterol, 1,4-sorbitan, pentaerythritols, for example, dipentaerythritol and tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxybenzene, and the like.

For acid components for forming polyester-type polymers, it may be possible to provide, for example, benzenedicarboxylic acids such as phthalic acid, isophthalic acid, and terephthalic acid and anhydrides thereof, alkyldicarboxylic acids such as succinic acid, adipic acid, sebacic acid, and azelaic acid, and anhydrides thereof, unsaturated dibasic acids such as maleic acid, citraconic acid, itaconic acid, alkenylsuccinic acids, fumaric acid, and mesaconic acid, unsaturated dibasic acid anhydrides such as maleic acid anhydride, citraconic acid anhydride, itaconic acid anhydrise, and alkenyl succinic acid anhydride, and the like. Furthermore, for tri- or more-hydric carboxylic acid components, it may be possible to provide trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropoane, tetra(methylenecarboxy)methane, 1,2,7,8-octanetetracarboxylic acid, EnPol trimer acid, and anhydrides and partially lower alkyl esters thereof, and the like.

When the binder resin is a polyester-type resin, at lease one peak being present in a region of molecular weight of 3,000-50,000 with respect to a molecular weight distribution of a THF soluble component in a resin component is preferable in view of the fixation property and offset resistance property of a toner, and furthermore, in regard to its THF soluble component(s), a binder resin in which a component with a molecular weight of 100,000 or less is in 60-100% is preferable and a binder resin in which at least one peak is present in a region of a molecular weight of 5,000-20,000 is more preferable.

When the binder resin is a polyester polymer, its acid value is preferably 0.1 mgKOH/g-100 mgKOH/g, more preferably 0.1 mgKOH/g-70 mgKOH/g, and most preferably 0.1 mgKOH/g-50 mgKOH/g.

In a specific embodiment of the present invention, the molecular weight distribution of a binder resin is measured by means of a gel permeation chromatography (GPC) in which a solvent is THF.

For binder reins capable of being used for a toner according to a specific embodiment of the present invention, it may also be possible to use a resin containing a monomer component capable of reacting with the vinyl polymer component and polyester-type resin component in at least either of these resin components. For monomers composing a polyester-type resin component and being capable of reacting with a vinyl polymer, it may be possible to provide, for example, unsaturated dicarboxylic acids such as phthalic acid, maleic acid, citraconic acid, and itaconic acid, and anhydrides thereof, and the like. For monomers composing a vinyl polymer component, it may be possible to provide ones having a carboxyl group or a hydroxyl group, and acrylic acid and methacrylic acid esters.

Furthermore, when the polyester-type polymer or vinyl polymer and (an)other binder resin(s) are used in combination, it is preferable to have 60% by mass or more of a resin in which the acid value of a binder resin is totally 0.1-50 mgKOH/g.

In a specific embodiment of the present invention, the acid value of a binder resin component in a toner composition is obtained by the following method whose basic operations are conformed with JIS (Japanese Industrial Standard) K-0070.

(1) For a sample, an additive(s) except a binder resin(s) (a polymer component(s)) is/are removed and used preliminarily or the acid value(s) and content(s) of a component(s) except a binder resin(s) and a cross-linked binder resin(s) have been obtained preliminarily. 0.5-2.0 g of a milled sample product is weighed wherein the weight of a polymer component is W g. For example, when the acid value of a binder resin is measured from a toner, the acid value(s) and content(s) of a coloring agent(s), a magnetic body(ies) and/or the like have been measured separately and the acid value(s) of a binder resin(s) is obtained by means of calculation.

(2) The sample is charged into a 300 ml beaker and 150 ml of a mixed liquid of toluene/ethanol (volume ratio: 4/1) is added and dissolved.

(3) A 0.1 mol/l solution of KOH in ethanol is used for titration using a potentiometric titration device.

(4) The amount of the KOH solution used herein is S (ml) while a blank is measured concurrently and the amount of the KOH solution used herein is B (ml), and calculation is made by the following formula:

$$\text{acid value(mgKOH/g)}=[(S-B)\times f\times 5.61]/W,$$

wherein f is a factor of KOH.

From the viewpoint of a toner storage property, the glass transition temperatures (Tg) of a toner binder resin and a composition containing a bunder resin are preferably 35-80° C., and more preferably 40-75° C. If Tg is lower than 35° C., a toner may readily degrade at a high temperature atmosphere and offset may readily occur at the time of its fixation. Furthermore, if Tg is over 80° C., its fixation property may be lowered.

For magnetic bodies usable for a specific embodiment of the present invention, it may be possible to use, for example, (1) magnetic iron oxides such as magnetite, maghemite, and ferrite, and iron oxides containing (an)other metal oxide(s), (2) metals such as iron, cobalt, and nickel, and alloys of such a metal(s) and a metal(s) such as aluminum, cobalt, copper, lead, magnesium, tin, zinc, antimony, beryllium, bismuth, cadmium, calcium, manganese, selenium, titanium, tungsten, and vanadium, (3) mixtures thereof, and the like.

As examples of the magnetic body(ies) are provided specifically, it may be possible to provide $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powders, cobalt powders, nickel powders, and the like. One kind of these may be used singly or two- or more kinds thereof may be used in combination. Among these, it may be possible to provide fine powders of iron oxide black and $\gamma$-iron sesquioxide particularly preferably.

Furthermore, it may also be possible to use magnetic iron oxides such as magnetite, maghemite, and ferrite which contain a heteroelement(s), and mixtures thereof. As examples of the heteroelement(s) are provided, it may be possible to provide, for example, lithium, beryllium, boron, magnesium, aluminum, silicon, phosphorus, germanium, zirconium, tin, sulfur, calcium, scandium, titanium, vanadium, chromium, manganese, cobalt, nickel, copper, zinc, gallium, and the like. A preferable heteroelement is selected from magnesium, aluminum, silicon, phosphorous, and zirconium. The heteroelement(s) may be included in a crystal lattice of an iron oxide, may be included in an iron oxide as an oxide(s), or may be present as an oxide or hydroxide on a surface, and is preferably contained as an oxide.

It may be possible to include the above-mentioned heteroelement(s) in a particle by mixing a salt of each heteroelement therein at the time of producing a magnetic body and adjusting the pH thereof. Furthermore, it may be possible to deposit it on a particle surface by adjusting the pH thereof, or adding a salt of each element and adjusting the pH thereof, after producing a particle of the magnetic body.

For the amount of the magnetic body(ies) used as mentioned above, 10-200 parts by mass of a magnetic body(ies) is preferable per 100 parts by mass of a binder resin, and 20-150 parts by mass is more preferable. For the number average particle diameters of these magnetic bodies, 0.1-2 μm is preferable and 0.1-5 μm is more preferable. A photograph enlarged and imaged by a transmission-type electron microscope is measured by a digitizer or the like whereby it may be possible to obtain the above-mentioned number average diameter.

Furthermore, for the magnetic characteristic(s) of the magnetic body(ies), the magnetic characteristics thereof at the time of application of 10 K oersteds are preferably a coercive force of 20-150 oersteds, a saturation magnetization of 50-200 emu/g, and a residual magnetization of 2-20 emu/g.

The above-mentioned magnetic body(ies) may also be used for a coloring agent(s).

[Coloring Agent]

While the above-mentioned coloring agent(s) is/are not particularly limited and it may be possible to select and use a commonly-used resin(s) appropriately, it may be possible to provide, for example, carbon blacks, nigrosin dyes, iron black, naphthol yellow S, Hansa yellows (10G, 5G, G), cadmium yellow, yellow oxide, loess, chrome yellow, titan yellow, polyazo yellow, oil yellow, Hansa yellows (GR, A, RN, R), pigment yellow L, benzidine yellows (G, GR), permanent yellow (NCG), vulcan fast yellows (5G, R), tartrazine lake, quinoline yellow lake, anthrazane yellow BGL, isoindolinone yellow, red iron oxide, red lead oxide, lead vermilion, cadmium red, cadmium mercury red, antimony vermilion, permanent red 4R, para red, faise red, para-chloro-ortho-nitroaniline red, lithol fast scarlet G, brilliant fast scarlet, brilliant carmine BS, permanent reds (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosine lake, rhodamine lake B, rhodamine lake Y, alizarin lake, thioindigo red B, thioindigo maroon, oil red, quinacridone red, pyrazolone red, polyazo red, a chrome vermillion, benzidine orange, perynone orange, oil orange, cobalt blue, cerulean blue, alkali blue lake, peacock blue lake, victoria blue lake, non-metal phthalocyanine blue, phthalocyanine blue, fast sky blue, indanthrene blues (RS, BC), indigo, ultramarine blue, prussian blue, anthraquinone blue, fast violet B, methyl violet lake, cobalt purple, manganese purple, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and mixtures thereof, and the like.

The content(s) of the coloring agent(s) in a toner is/are preferably 1-15% by mass and more preferably 3-10% by mass.

It may be possible to use a coloring agent to be used for a toner according to a specific embodiment of the present invention as a master batch which is combined with a resin. For binder resins to manufacture a master batch or to be kneaded with a master batch, it may be possible to provide, for example, polymers of styrenes such as polystyrene, poly-p-chlorostyrene, and polyvinyl toluene and substituted ones thereof; styrene-type copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-$\alpha$-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymers; polymethyl methacrylate, polybutyl methacrylate, polyvinyl chloride, polyvinyl acetate, polyethylene, polypropylene, polyesters, epoxy resins, epoxypolyol resins, polyurethanes, polyamides, polyvinyl butyral, polyacrylic acid resins, rosin, modified rosins, terpene resins, aliphatic and alicyclic hydrocarbon resins, aromatic petroleum resins, chlorinated paraffins, paraffin wax, and the like, in addition to the previously provided modified and unmodified polyester resins. One kind of them may be used singly or two- or more-kinds of them may be mixed and used.

It may be possible to obtain the above-mentioned master batch by applying a shear force to and mixing and kneading a resin(s) for master batch and a coloring agent(s). Then, it may be possible to use an organic solvent(s) in order to enhance the interaction between the coloring agent(s) and the resin(s). Furthermore, a method for mixing and kneading an aqueous paste of a coloring agent(s) which contains water with a resin(s) and an organic solvent(s) so as to transfer the coloring agent(s) to the side of the resin(s) and removing the water content and the organic solvent component, which is referred to as a so-called flushing method, is preferably used, because it may be possible to use a wet cake of the coloring agent(s) directly, and accordingly, its drying is not required. For the mixing and kneading, a high shear dispersion device such as a triple roll mill is used preferably.

For the amount of the master batch used as mentioned above, 0.1-20 parts by mass per 100 parts by mass of a binder resin(s) is preferable.

Furthermore, while the acid value(s) and amine value(s) of the above-mentioned resin for master batch are 30 mgKOH/g or less and 1-100, respectively, and it is preferable to disperse and use a coloring agent(s), it is more preferable that the acid value(s) is/are 20 mgKOH/g or less, the amine value(s) is/are 10-50, and a coloring agent(s) is/are dispersed and used. If the acid value(s) is/are over 30 mgKOH/g, a charging property at a high humidity may be lowered and a pigment dispersing property may also be insufficient. Furthermore, when the amine value(s) is/are less than 1 and the amine value(s) is/are over 100, a pigment dispersing property may also be insufficient. Additionally, it may be possible to measure an acid value(s) according to a method described in JIS K0070 and it may be possible to measure an amine value(s) according to a method described in JIS K7237.

Moreover, it is preferable that the compatibility(ies) of a dispersing agent(s) with a binder resin(s) is/are high in view of its/their pigment dispersing property, and for its/their specific commercial product(s), it may be possible to provide "Adisper PB821" and "Adisper PB822" (produced by Ajinomoto Fine-Techno Co., Inc.), "Disperbyk-2001" (produced by BYK-Chemie GmbH), "EFKA-4010" (produced by EFKA Additive BV), and the like.

The above-mentioned dispersing agent(s) is/are preferably compounded in a toner at a rate of 0.1-10% by mass per a coloring agent(s). If the compounding rate is less than 0.1% by mass, its/their pigment dispersing property(ies) may be insufficient, and if it is more than 10% by mass, a charging property at a high humidity may be lowered.

For the weight-average molecular weight(s) of the above-mentioned dispersing agent(s), a molecular weight for a main peak is preferably 500-100,000 in a styrene equivalent weight in a gel permeation chromatography, and more preferably 3,000-100,000 from the viewpoint of a pigment dispersing property(ies). In particular, 5,000-50,000 are preferable, and 5,000-30,000 are most preferable. If the molecular weight is less than 500, a polarity may be high and the dispersion property(ies) of a coloring agent(s) may be lowered, and if the molecular weight is over 100,000, its/their affinity(ies) with a solvent(s) may be high and the dispersion property(ies) of a coloring agent(s) may be lowered.

The amount(s) of the dispersing agent(s) to be added is/are preferably 1-200 parts by mass per 100 parts by mass of a coloring agent(s) and more preferably 5-80 parts by mass. If it is less than 1 part by mass, its/their dispersion property(ies) may be lowered, and if it is over 200 parts by mass, a charging property(ies) may be lowered.

[Other Components]

<Carrier>

A toner according to a specific embodiment of the present invention may be mixed with a carrier and used as a two-component developer. For the above-mentioned carrier, it may also be possible to use a resin coat carrier as well as normal carriers such as ferrite and magnetite ones.

The resin coat carrier is composed of a carrier core particle and a coating material which is a resin coating (covering) a surface of the carrier core particle.

For the resins to be used for the above-mentioned coating material, it may be possible to provide styrene-acryl-type resins such as styrene-acrylic acid ester copolymers and styrene-methacrylic acid ester copolymers, acryl-type copolymers such as acrylic acid ester copolymers and methacrylic acid ester copolymers, fluorine-containing resins such as polytetrafluoroethylene, monochrolotrifluoroethylene polymer, and polyvinylidene fluoride, silicone resins, polyester resins, polyamide resins, polyvinyl butyral, and aminoacrylate resins, preferably. In addition, it may be possible to provide resins usable as a coating (covering) material for a carrier such as ionomer resins, polyphenylene sulfide resins, and the like. One kind of these resins may be used singly or two- or more-kinds thereof may be used in combination. It may also be possible to use a binder-type carrier core in which a magnetic powder is dispersed in a resin.

For a method for coating a surface of a carrier core with at least a resin coating agent in a resin coat carrier, it may be possible to apply a method for dissolving or suspending a resin in a solvent and applying it to a carrier core to adhere thereto, and a method for simply mixing them in a powder state.

While the rate of a resin coating material to the above-mentioned resin coat carrier may be determined appropriately, 0.01-5% by mass are preferable with respect to the resin coat carrier and 0.1-1% by mass is more preferable.

For usable examples for coating a magnetic body with a coating (covering) agent of a mixture of two or more kinds thereof, it may be possible to provide (1) 100 parts by mass of titanium oxide fine powder treated with 12 parts by mass of a mixture of dimethyldichlorosilane and dimethylsilicone oil (mass ratio 1:5) and (2) 100 parts by mass of silica fine powder treated with 20 parts by mass of a mixture of dimethyldichlorosilane and dimethylsilicone oil (mass ratio 1:5).

Among the above-mentioned resins, mixtures of a styrene-methyl methacrylate copolymer, a fluorine-containing resin and a styrene-type copolymer, and silicone resins, are used preferably, and silicone resins are particularly preferable.

For the mixtures of a fluorine-containing resin and a styrene-type copolymer, it may be possible to provide, for example, mixtures of polyvinylidene fluoride and styrene-methyl methacrylate copolymer, mixtures of polytetrafluoroethylene and styrene-methyl methacrylate copolymer, and mixtures of vinylidene fluoride-tetrafluoroethylene copolymer (copolymer mass ratio 10:90-90:10), styrene-2-ethylhexyl acrylate copolymer (copolymerization mass ratio 10:90-90:10), and styrene-2-ethylhexyl acrylate-methyl methacrylate copolymer (copolymer mass ratio 20-60:5-30:10:50).

For the silicone resins, it may be possible to provide a modified silicone resin produced by reacting a nitrogen-containing silicone resin and a nitrogen-containing silane coupling agent with a silicone resin.

For the magnetic materials for a carrier core, it may be possible to use, for example, oxides such as ferrite, iron-excess-type ferrites, magnetite, and γ-iron oxide, metals such as iron, cobalt, and nickel, and alloys thereof.

Furthermore, for elements contained in these magnetic materials, it may be possible to provide iron, cobalt, nickel, aluminum, copper, lead, magnesium, tin, zinc, antimony, beryllium, bismuth, calcium, manganese, selenium, titanium, tungsten, and vanadium. Among these, it may be possible to provide copper-zinc-iron-type ferrite whose main components are copper, zinc and iron components and manganese-magnesium-iron-type ferrite whose main components are manganese, magnesium and iron components, particularly preferably.

The value of resistance of the above-mentioned carrier is preferably $10^6$-$10^{10}$ Ωcm by adjusting the degree of irregularity of a surface of the carrier and the amount of a coating resin.

While it may be possible to use 4-200 μm for the particle diameter of the above-mentioned carrier, 10-150 μm are preferable and 20-100 μm are more preferable. In particular, the 50% particle diameter of a resin coat carrier is preferably 20-70 μm.

For the two-component-type developers, it may be preferable to use 1-200 parts by mass of a toner according to a specific embodiment of the present invention per 100 parts by mass of a carrier, and it may be more preferable to use 2-50 parts by mass of a toner per 100 parts by mass of a carrier.

<Wax>

Moreover, it may also be possible to contain a wax(es) as well as a binder resin(s) and a coloring agent(s) in a specific embodiment of the present invention.

While the above-mentioned wax(es) is/are not particularly limited and it may be possible to select and use commonly used ones appropriately, it may be possible to provide, for example, aliphatic hydrocarbon-type waxes such as low molecular weight polyethylenes, low molecular weight polypropylenes, polyolefin waxes, microcrystalline waxes, paraffin waxes, and sasol wax, oxides of aliphatic hydrocarbon-type waxes such as oxidized polyethylene waxes and block copolymers thereof, plant-type waxes such as candelilla wax, carnauba wax, vegetable wax, and jojoba wax, animal-type waxes such as bees wax, lanolin, and spermaceti wax, mineral-type waxes such as ozokerite, ceresin, and petrolatum, aliphatic acid ester-based waxes such as montan acid ester wax and castor wax, partially or entirely deoxidized aliphatic acid esters such as deoxidized carnauba waxes, and the like.

For examples of the above-mentioned wax(es), it may be possible to further provide saturated straight chain fatty acids such as palmitic acid, stearic acid, montanic acid, and further straight chain alkyl carboxylic acids having a straight chain alkyl group, unsaturated fatty acids such as brassidic acid, eleostearic acid, and varinaline acid, saturated alcohols such as stearyl alcohol, eicosyl alcohol, behenyl alcohol, carnaubyl alcohol, ceryl alcohol, mesityl alcohol, and long chain alkyl alcohols, polyhydric alcohols such as sorbitol, fatty acid amides such as linoleic acid amide, olefin acid amide, and lauric acid amide, saturated fatty acid bisamides such as methylenebis capric acid amide, ethylenebis lauric acid amide, and hexamethylenebis stearic acid amide, unsaturated fatty acid amides such as ethylenebis oleic acid amide, hexamethylenebis oleic acid amide, N,N'-dioleyladipic acid amide, and N,N'-dioleyl sebacic acid amide, aromatic bisamides such as m-xylenebis stearic acid amide and N,N-distearylisophthalic acid amide, fatty acid metal salts such as calcium stearate, calcium laurate, zinc stearate, and magnesium stearate, grafted waxes in which a vinyl-type monomer such as styrene or acrylic acid is used for an aliphatic hydrocarbon-type wax, partial ester compounds of a fatty acid such as behenic acid monoglyceride and a polyhydric alcohol, and methyl ester compounds having a hydroxyl group that are obtainable by hydrogenating a vegetable oil.

For more preferable examples thereof, it may be possible to provide polyolefins for which an olefin has been radical-polymerized at a high pressure, polyolefins for which a low molecular weight by-product obtainable at the time of polymerization of a high molecular weight polyolefin has been purified, polyolefins for which polymerization has been conducted by using a catalyst such as a Ziegler catalyst or metallocene catalyst at a low pressure, polyolefins for which polymerization has been conducted by utilizing a radiation ray, an electromagnetic wave or light, low molecular weight polyolefins obtainable by conducting thermal decomposition of a high molecular weight polyolefin, paraffin waxes, microcrystalline waxes, Fischer-Tropsch waxes, synthesized hydrocarbon waxes synthesized by a synthol method, a hydrocol method, an arge method, or the like, synthesized waxes for which a compound whose carbon number is one has been a monomer, hydrocarbon-type waxes having a functional group such as a hydroxyl group or a carboxyl group, mixtures of a hydrocarbon-type wax and a hydrocarbon-type wax having a functional group, and waxes for which such a wax is a base material and graft modification has been conducted by a vinyl monomer such as styrene, a maleic acid ester, an acrylate, a methacrylate, or maleic acid anhydride.

Furthermore, it is also preferable to use these waxes while their molecular weight distributions are sharpened by using a press sweating method, a solvent method, a recrystallization method, a vacuum distillation method, a supercritical gas extraction method, or a solution crystallization method, or while a low molecular weight solid fatty acid(s), a low molecular weight solid alcohol(s), a low molecular weight solid compound(s), and/or (an)other impurity(ies) has/have been eliminated therefrom.

The melting point(s) of the wax(es) is/are preferably 70-140° C., and more preferably 70-120° C., in order to achieve a balance between the fixation property(ies) and offset resistance property(ies) thereof. If it/they is/are less than 70° C., the offset resistance property(ies) may degrade, and if it/they is/are over 140° C., the effect of such an offset resistance may hardly be expressed.

Furthermore, it may be possible to express a plasticizing effect and a releasing effect which are effects of waxes simultaneously by using two or more different kinds of waxes in combination.

For the kinds of waxes having a plasticizing effect, it may be possible to provide, for example, waxes with a low melting point, ones with a branch in the molecular structure thereof, and ones with a structure having a polar group, and the like.

For waxes having a releasing effect, it may be possible to provide waxes with a high melting point, and for their molecular structures, it may be possible to provide straight chain structures and non-polar ones having no functional group. For examples of their use, it may be possible to provide combinations of two or more different kinds of waxes whose melting point difference is 10° C.-100° C., combinations of a polyolefin and a graft-modified polyolefin, and the like.

When two kinds of waxes are selected from waxes with similar structures, a wax with relatively low melting point expresses a plasticizing effect while a wax with a higher melting point expresses a releasing effect. Herein, when the difference between the melting points is 10-100° C., the function separation thereof is expressed effectively. If it is less than 10° C., the effect of the function separation may hardly be expressed, and if it is over 100° C., a functional enhancement caused by their interaction may hardly be provided. Herein, the melting point of at least one of waxes is preferably 70-120° C. and more preferably 70-100° C., to provide a tendency such that expression of the function separation effect is facilitated.

In regard to the waxes, ones with a branching structure, ones having a polar group such as a functional group, and ones modified with a component different from a main component express plasticizing effects, while ones with a relatively straight structure, non-polar ones having no functional group, and unmodified straight ones express releasing effects. For preferable combinations thereof, it may be possible to provide combinations of polyethylene homopolymer or copolymer based on ethylene and a polyolefin homopolymer or copolymer based on an olefin except ethylene, combinations of a polyolefin and a graft-modified polyolefin, combinations of an alcohol wax, fatty acid wax or ester wax and a hydrocarbon-type wax, combinations of a Fischer-Tropsch wax or polyolefin wax and a paraffin wax or microcrystal wax, combinations of a Fischer-Tropsch wax and a polyolefin wax, combinations of a paraffin wax and a microcrystal wax, and combinations of carnauba wax, candelilla wax, rice wax or montan wax and a hydrocarbon-type wax.

In any case, among endothermic peaks observed in a DSC measurement of a toner, it is preferable that there is a peak top temperature of the maximum peak in a region of 70-110° C., and it is more preferable to have the maximum peak in a region of 70-110° C., in order to achieve a balance the storage property and fixation property of a toner readily.

The total content of the above-mentioned waxes is preferably 0.2-20 parts by mass, and more preferably 0.5-10 parts by mass, per 100 parts by weight of a binder resin.

In a specific embodiment of the present invention, the melting point of a wax is a peak top temperature of the maximum peak among endothermic peaks of a wax wherein it is measured by means of DSC.

For a DSC measurement instrument for the above-mentioned wax or toner, it is preferable to conduct a measurement by a high resolution inner heat-type and input compensation-type differential scanning calorimeter. Such a measurement method is conducted so as to be in accordance with ASTM D3418-82. For a DSC curve to be used for a specific embodiment of the present invention, a measurement is used in which temperature elevation and temperature drop are once conduced to obtain a pre-hysteresis and subsequently and temperature elevation is conducted at a temperature rate of 10° C./min.

<Fluidity Improving Agent>

A fluidity improving agent(s) may be added into a toner according to a specific embodiment of the present invention. The above-mentioned fluidity improving agent(s) are added onto a toner surface, and thereby, improve(s) the fluidity of a toner (facilitate(s) its flow).

For the above-mentioned fluidity improving agent(s), it may be possible to provide, for example, carbon blacks, fluorine-type resin powders such as vinilidene fluoride fine powders and polytetrafluoroethylene fine powders, silica fine powders such as wet-process-manufactured silicas and dry-process-manufactured silicas, titanium oxide fine powders, alumina fine powders, treated silicas, treated titanium oxide and treated alumina for which surface treatment thereof has been conducted with a silane coupling agent, a titanium coupling agent, or a silicone oil, and the like. Among these, silica fine powders, titanium oxide fine powders, and alumina fine particles are preferable and treated silicas are more preferable for which surface treatment thereof has been conducted with a silane coupling agent or a silicone oil.

For particle diameter(s) of the above-mentioned fluidity improving agent(s), an average primary particle diameter of 0.001-2 μm is preferable and 0.002-0.2 μm are more preferable.

The above-mentioned silica fine powder(s) is/are fine powder(s) produced by means of gas-phase oxidation of a silicon halide compound(s) and referred to as so-called dry-process silica(s) or fumed silica(s).

For commercially available silica fine powders produced by means of gas-phase oxidation of a silicon halide compound(s), it may be possible to provide, for example, AEROSIL-130, -300, -380, -TT600, -MOX170, -MOX80, and -COK84 (commercial names, Nippon Aerosil Co., Ltd.); CaO-SiL-M-5, -MS-7, -MS-75, -HS-5, and -EH-5 (commercial names, CABOT Corporation); Wacker HDK-N20, -V15, -N20E, -T30, and -T40 (commercial names, WACKER-CHEMIE GmbH); D-CFineSilica (commercial name, Dow Corning Corporation); Fransol (commercial name, Fransil K.K.), and the like.

Furthermore, treated silica fine powders for are more preferable which a silica fine powder produced by means of gas-phase oxidation of a silicon halide compound is hydrophobic-treated. For the treated silica fine powder(s), a silica fine powder(s) is/are particularly preferably treated so that its/their hydrophobicity(ies) measured by a methanol titration test preferably indicate(s) a value(s) of 30-80%. Its/their hydrophobic treatment is attained by chemically or physically treating it/them with an organic silicon compound(s) that react(s) with or physically adsorb(s) to a silica fine powder(s). For a preferable method, a method for treating a silica fine powder produced by means of gas-phase oxidation of a silicon halide compound with an organic silicon compound is preferable.

For an organic silicon compound(s), it may be possible to provide hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxanes having 2 to 12 siloxane units per 1 molecule and containing 0 to 1 hydroxyl group bonding to Si in both units located at the terminals thereof, and the like. Furthermore, it may be possible to provide silicone oils such as dimethylsilicone oil. One kind of these may be used singly or two or more kinds thereof may be mixed and used.

For the number average particle diameter(s) of the fluidity improving agent(s), 5-100 nm are preferable and 5-50 nm are more preferable.

For its/their specific surface area(s) in accordance with nitrogen adsorption measured by a BET method, 30 $m^2/g$ or more are preferable and 60-400 $m^2/g$ are more preferable.

For the surface-treated fine powder(s), 20 $m^2/g$ or more are preferable and 40-300 $m^2/g$ are more preferable.

For the application amount of these fine powders, 0.03-8 parts by mass per 100 parts by mass of a toner particle(s) are preferable.

To a toner according to a specific embodiment of the present invention, it may be possible to add each kind of metal soap, a fluorine-type surfactant(s), and/or dioctyl phthalate for the purpose of protection of an electrostatic latent image supporter or carrier, improvement of its cleaning property, adjustment of its thermal property, electrical property, and/or physical property(ies), adjustment of its resistance, adjustment of its softening point, improvement of its fixation rate, and/or the like, and/or tin oxide, zinc oxide, a carbon black(s), antimony oxide, and/or the like as an electrical conductivity providing agent(s), and/or an inorganic fine powder(s) such as titanium oxide, aluminum oxide, and/or alumina, and/or the like, as (an)other additive(s) according to need. To these inorganic fine powders, hydrophobic treatment may be applied according to need. Furthermore, it may also be possible to use a small amount of a lubricant(s) such as polytetrafluoroethylenes, zinc stearate, and/or polyvinilidene fluorides, an abrasive(s) or caking inhibitor(s) such as cesium oxide, silicon carbide, and/or strontium titanate, and/or further a white color fine particle(s) and/or black color fine particle(s) with a polarity opposing that/those of a toner particle(s) as a development property improving agent(s). It is also preferable that these additives are treated with a treating agent(s) such as a silicone varnish(es), each kind of modified silicone varnish, a silicone oil(s), each kind of modified silicone oil, a silane coupling agent(s), a silane coupling agent(s) having a functional group, and/or (an)other organic silicon compound(s) for the purpose of its charge control or the like, or various kinds of treating agents.

When a developer is prepared, the previously provided inorganic fine particle(s) such as hydrophobic silica fine powders may be added and mixed in order to improve the fluidity, storage property, development property, and/or transfer property of the developer. For mixing of an external additive(s), it may be possible to select and use a general powder mixer appropriately and it is preferable to be equipped with a jacket or the like so that it may be possible to adjust the temperature of its inside. In order to change the history of a load applied to an external additive(s), it may be only necessary to add an external additive(s) in the middle or little by little and the rotational frequency, rolling speed, time period, temperature and/or the like of a mixer may be changed, wherein first, a large load, and then, relatively smaller load, may be applied or vice versa.

For examples of usable mixers, it may be possible to provide, for example, a V-mixer, a rocking mixer, a loedige mixer, a nauta mixer, and a henschel mixer, and the like.

While a method for further adjusting an obtained toner shape is not particularly limited and may be able to be selected appropriately according to its purpose, it may be possible to provide, for example, a method for mechanically adjusting a shape of one provided by melting and kneading and subsequently milling a toner material composed of a binder resin(s) and a coloring agent(s) while a hybridizer, a mechanofusion, or the like is used, a method for dissolving or dispersing a toner material in a solvent in which a toner binder(s) is/are soluble and subsequently conducting desolvation using a spray dry device so as to obtain a spherical toner, which is referred to as so-called spray-dry method, a method for conducing its heating in an aqueous medium so as to provide a spherical one, and the like.

For the above-mentioned external additive(s), it may be possible to use an inorganic fine particle(s) preferably.

For the above-mentioned inorganic fine particle(s), it may be possible to provide, for example, silica, alumina, titanium oxide, barium titanate, magnesium titanate, calcium titanate, strontium titanate, zinc oxide, tin oxide, silica sand, clays, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride, and the like.

For the primary particle diameter(s) of the above-mentioned inorganic fine particle(s), 5 mμ-2 μm are preferable and 5 mμ-500 mμ are more preferable.

For its/their specific surface area(s) in the above-mentioned BET method, 20-500 $m^2/g$ are preferable.

For the rate of the above-mentioned used inorganic fine particle(s), 0.01-5% by mass of a toner are preferable and 0.01-2.0% by mass are more preferable.

In addition, it may be possible to provide polymer-type fine particles, for example, polymer particles made of polystyrenes obtainable by means of soap-free emulsion polymerization, suspension polymerization, or dispersion polymerization, copolymers of a methacrylic acid ester(s) and/or an acrylic acid ester(s), condensation polymerization systems of a silicone(s), benzoguanamine, a nylon(s), and/or the like, and thermosetting resins.

For such an external additive(s), it may be possible to enhance its/their hydrophobicity by means of a surface-treating agent(s) so as to prevent the external additive(s) itself/themselves from degrading even at a high humidity.

For the above-mentioned surface treating agent(s), it may be possible to provide, for example, silane coupling agents, silylating agents, silane coupling agents having a fluoride alkyl group, organic titanate-type coupling agents, aluminum-type coupling agents, silicone oils, modified silicone oils, and the like, preferably.

For the primary particle diameter(s) of the above-mentioned inorganic fine particle(s), 5 mμ-2 μm are preferable and 5 mμ-500 mμ are more preferable. Also, for its/their specific surface area(s) in a BET method, 20-500 $m^2/g$ are preferable. For the rate of the used inorganic fine particle(s), 0.01-5% by weight of a toner are preferable and 0.01-2.0% by weight are more preferable.

For a cleaning property improving agent(s) for removing a developer after its transfer as remaining on an electrostatic latent image carrier or a primary transfer medium, it may be possible to provide, for example, metal salts of fatty acids such as zinc stearate, calcium stearate, and stearic acid, polymer fine particles manufactured by means of soap-free emulsion polymerization such as polymethyl methacrylate fine particles and polystyrene fine particles, and the like. The particle size distribution(s) of polymer fine particles is/are comparatively narrow, and their volume-average particle diameter(s) is/are preferably 0.01 to 1 μm.

For a development method using a toner according to a specific embodiment of the present invention, it may be possible to use any of electrostatic latent image carriers to be used for conventional electrophotographic methods, and for example, an organic electrostatic latent image carrier, an amorphous silica electrostatic latent image carrier, a selenium electrostatic latent image carrier, a zinc oxide electrostatic latent image carrier, or the like is preferably usable.

Next, specific and practical examples will be described.

Although an embodiment of the present invention will be described by practical examples in more detail below, the present invention is not limited at all to any of the practical examples as described below.

Practical Example 1

Preparation of a Coloring Agent Liquid Dispersion

First, a liquid dispersion of a carbon black as a coloring agent was prepared.

17 parts by mass of a carbon black (Rega 1400; produced by Cabot Corporation) and 3 part by mass of a pigment dispersing agent were primarily dispersed in 80 parts by mass of ethyl acetate by using a mixer having an agitation wing. For the pigment dispersing agent, AJISPER PB821 (produced by Ajinomoto Fine-Techno Co., Inc.) was used. The obtained primary liquid dispersion was dispersed finely by a strong shearing force of a used dyno-mill so as to prepare a secondary liquid dispersion in which 5 μm or larger aggregates had been removed completely.

—Preparation of a Wax Liquid Dispersion—

Next, a liquid dispersion of a wax was prepared.

18 parts by mass of a carnauba wax and 2 parts by mass of a wax dispersing agent were primarily dispersed in 80 parts by mass of ethyl acetate by using a mixer having an agitation wing. While this primary liquid dispersion was agitated, its temperature was raised up to 80° C. so as to dissolve the carnauba wax, and subsequently, wax particles were precipitated by lowering its liquid temperature to room temperature such that their maximum diameter was 3 μm or less. For the wax dispersing agent, a polyethylene wax grafted with a styrene-butyl acrylate copolymer was used. The obtained liquid dispersion was further dispersed finely by a strong shearing force of a used dyno-mill and prepared such that their maximum diameter was 2 μm or less.

—Preparation of a Toner Composition Liquid Dispersion—

Next, a toner composition liquid dispersion in which the above-mentioned coloring agent liquid dispersion and the above-mentioned wax liquid dispersion were added to a resin as a binder resin was prepared to have the following composition.

100 parts by mass of a polyester resin as a binder resin, 30 parts by mass of the above-mentioned coloring agent liquid dispersion, and 30 parts by mass of the wax liquid dispersion, were uniformly dispersed in 840 parts by mass of ethyl acetate while agitation using a mixer having an agitation wing was conducted for 10 minutes. No pigment or wax particle was aggregated by means of a shock of solvent dilution.

—Manufacturing of a Toner—

The obtained liquid dispersion was supplied to the liquid drop jetting unit 2 as illustrated in FIG. 13 for the toner manufacturing device as described above. Ejection holes (nozzles) were provided in a hound's tooth manner such that each distance between the ejection holes was 100 μm. A liquid storage part (storage part) composed of equally partitioned liquid storage regions (storage chambers) was used.

The frequency of excited vibration and the configuration of the liquid storage part, used in the present practical example, are described below. Herein, all the waveform of a voltage applied to vibration means was a sinusoidal waveform. Furthermore, only one liquid drop jetting unit 2 as illustrated in FIG. 13 was provided to conduct evaluations. Moreover, the flow rate of air stream supplied through the air flow channel 37 of the liquid drop jetting unit 2 was such that its average linear velocity near the nozzles was 20 m/s.

<Configuration of a Storage Part>

Frequency of excited vibration: 60 kHz Number of partitioned storage parts (number of storage chambers): 6

Width "A" of a storage chamber in its longitudinal direction: 8 mm

Width "B" of a storage chamber in its lateral direction: 5 mm

After preparing the liquid dispersion, a liquid drop was ejected on the condition that a dried nitrogen gas in the device was in 30.0 L/minute, and subsequently the liquid drop was dried and solidified so as to manufacture a toner base particle.

After the dried and solidified toner particle was collected by means of cyclotron, external addition treatment with 1.0% by weight of a hydrophobic silica (H2000, produced by Clariant (Japan) K. K.) was conducted by using a Henschel mixer (produced by MITSUI MINING COMPANY, LIMITED.) so as to obtain a black toner. When the particle sizes of the collected particles and the particle size distribution of the collected particles were measured by a flow-type particle image analyser (FPIA-2000) on the measurement conditions described below, a weight-average particle size (D4) of 5.4 μm and a number-average particle size (Dn) of 4.2 μm were obtained for the toner base particles. Furthermore, the amount of toner base particles obtained in an operation for 1 hour was 204 g.

—Evaluations of Toner—

The following evaluations were conducted for the obtained toner. Herein, their results were provided in Table 1.

<Particle Size Distribution>

A measurement method using a flow-type particle image analyzer will be described below.

For measurements of a toner, toner particle and external additive by a flow-type particle image analyzer, it was possible to conduct measurement using, for example, flow-type particle image analyzer FPIA-2000 produced by Toa Medical Electronics Co., LTD.

For the measurements, the particle size distribution of particles having an equivalent circle diameter of 0.60 μm or more and less than 159.21 μm was measured by eliminating a fine contaminant through a filter, adding several drops of a nonionic surfactant (preferably, Contaminon N produced by Wako Pure Chemical Industries, Ltd.) into 10 ml of the resultant water in which the number of particles in a measuring range (for example, an equivalent circle diameter of 0.60 μm or more and less than 159.21 μm) was 20 or less in $10^{-3}$ $cm^{-3}$ of water, further adding 5 mg of a measurement sample, conducting a dispersion treatment for 1 minute by an ultrasonic disperser UH-50 produced by STM Corporation on the conditions of 20 kHz and 50 W/10 $cm^3$, further conducting dispersion treatment for 5 minutes in total, and using a sample dispersing liquid in which the concentration of particles of the measurement sample was 4,000-8,000/$10^{-3}$ $cm^3$ (targeted at particles in a range of equivalent circle diameter of measurement).

The sample liquid dispersion was passed through the flow channel (extending in a flow direction) of a flat and planar transparent flow cell (with a thickness of about 200 μm). In order to form a path of light passing through and intersecting with the flow cell in the direction of its thickness, a stroboscope and a CCD camera were mounted on the flow cell so as to be located at the opposite side of each other. While the sample liquid dispersion flowed, light irradiation by the stroboscope was provided at an interval of 1/30 seconds so as to obtain an image of a particle(s) being flowing in the flow cell, and as a result, each particle was imaged as a two-dimensional image having a certain area parallel to the flow cell. Based on the surface area of each particle in the two-dimensional image, the diameter of a circle having the same surface area was calculated as an equivalent circle diameter.

It was possible to measure equivalent circle diameters of 1,200 or more particles for about 1 minute and it was possible to measure a number based on an equivalent circle diameter distribution and the rate (number %) of a particle(s) having a predetermined equivalent circle diameter. It was possible to obtain their results (frequency % and cumulative %) by dividing a range of 0.06-400 μm into 226 channels (dividing 1 octave into 30 channels) as provided in Table 1. In the actual measurement, a measurement of particles was conducted in a range of an equivalent circle diameter of 0.60 μm or more and less than 159.21 μm.

<Reproducibility of a Thin Line>

A developer was introduced into a modified machine provided by modifying a development machine part of a commercially available copying machine (imagio Neo 271; produced by Ricoh Company, Ltd.) and its running at a character printing rate or image occupation rate of 7% was conducted by using "6000" papers produced by Ricoh Company, Ltd. Then, thin line portions of an initial tenth image and thirty thousandth image were compared with that of an original one and observed by an optical microscope at a magnification of 100 times, and the state of a defect of a line was compared with its standard samples and evaluated on a scale of one to four. An image quality was higher in the order of A>B>C>D. In particular, the evaluation "D" is an unacceptable level for a product. An organic electrostatic latent image carrier was used for a negatively-charged polar toner and an amorphous silicon electrostatic latent image carrier was used for a positively-charged polar toner.

In a development method, a resin-coated carrier that had been used in a conventional electrophotography was used as delivering means. The following carrier was used.

[Carrier]

Core material: spherical ferrite particle with an average particle diameter of 50 μm Coating material component: silicone resin After a liquid dispersion was prepared by dispersing a silicone resin in toluene, its spray coating was applied on the above-mentioned core material on a warming condition, and subsequently its firing and cooling was made to create a carrier particle with an average coating resin film thickness of 0.2 μm.

Practical Example 2

A target toner was obtained on the same conditions as those of practical example 1 except that the dimension "B" of a liquid storage part in its lateral direction was 8 mm.

Dried and solidified toner particles were collected by means of cyclotron. When the particle sizes of the collected particles and the particle size distribution of the collected particles were measured by a flow-type particle image analyzer (FPIA-2000) on the measurement conditions as described above, their weight-average particle diameter (D4) was 5.4 μm and their number-average particle diameter (Dn) was 5.1 μm. Then, the amount of the toner produced for 1 hour was 295 g.

Practical Example 3

A target toner was obtained on the same conditions as those of practical example 1 except that the number of partitioned liquid storage parts was 10 and the dimension "B" of a liquid storage part in its lateral direction was 8 mm.

Dried and solidified toner particles were collected by means of cyclotron. When the particle sizes of the collected particles and the particle size distribution of the collected particles were measured by a flow-type particle image analyzer (FPIA-2000) on the measurement conditions as described above, their weight-average particle diameter (D4) was 5.4 μm and their number-average particle diameter (Dn) was 4.9 μm. Then, the amount of the toner produced for 1 hour was 480 g.

Practical Example 4

A target toner was obtained on the same conditions as those of practical example 1 except that the vibration means was changed to those of a higher frequency, the frequency of excited vibration was 100 kHz, the width "A" of a storage chamber in its longitudinal direction was 6 mm, and the width "B" of a storage chamber in its lateral direction was 5 mm.

Dried and solidified toner particles were collected by means of cyclotron. When the particle sizes of the collected particles and the particle size distribution of the collected particles were measured by a flow-type particle image analyzer (FPIA-2000) on the measurement conditions as described above, their weight-average particle diameter (D4) was 5.1 μm and their number-average particle diameter (Dn) was 4.8 μm. Then, the amount of the toner produced for 1 hour was 270 g.

Practical Example 5

A target toner was obtained on the same conditions as those of practical example 1 except that the vibration means was changed to those of a higher frequency, the frequency of excited vibration was 100 kHz, the width "A" of a storage chamber in its longitudinal direction was 8 mm, and the width "B" of a storage chamber in its lateral direction was 5 mm.

Dried and solidified toner particles were collected by means of cyclotron. When the particle sizes of the collected particles and the particle size distribution of the collected particles were measured by a flow-type particle image analyzer (FPIA-2000) on the measurement conditions as described above, their weight-average particle diameter (D4) was 5.3 μm and their number-average particle diameter (Dn) was 4.9 μm. Then, the amount of the toner produced for 1 hour was 295 g.

Comparative Example 1

A target toner was obtained on the same conditions as those of practical example 1 except that the storage part 11 had a non-partitioned structure, that is, was one storage chamber (the number of the storage chamber is one), the width "A" of a storage part in its longitudinal direction was 50 mm, and the width "B" of a storage part in its lateral direction was 8 mm.

Dried and solidified toner particles were collected by means of cyclotron. When the particle sizes of the collected particles and the particle size distribution of the collected particles were measured by a flow-type particle image analyzer (FPIA-2000) on the measurement conditions as described above, their weight-average particle diameter (D4) was 5.5 μm and their number-average particle diameter (Dn) was 5.1 μm. Then, the amount of the toner produced for 1 hour was 113 g.

Comparative Example 2

A target toner was obtained on the same conditions as those of practical example 1 except that the vibration means was changed to those of a higher frequency, the frequency of excited vibration was 100 kHz, the storage part 11 had a non-partitioned structure, that is, was one storage chamber (the number of the storage chamber is one), the width "A" of a storage part in its longitudinal direction was 50 mm, and the width "B" of a storage part in its lateral direction was 8 mm.

Dried and solidified toner particles were collected by means of cyclotron. When the particle sizes of the collected particles and the particle size distribution of the collected particles were measured by a flow-type particle image analyzer (FPIA-2000) on the measurement conditions as described above, their weight-average particle diameter (D4)

was 5.2 μm and their number-average particle diameter (Dn) was 4.4 μm. Then, the amount of the toner produced for 1 hour was 163 g.

TABLE 1

| | Weight average particle diameter [μm] | Number average particle diameter [μm] | Production quantity per unit time [g/hr] | Thin line reproducibility |
|---|---|---|---|---|
| Practical example 1 | 5.4 | 5.2 | 204 | A |
| Practical example 2 | 5.4 | 5.1 | 295 | A |
| Practical example 3 | 5.4 | 4.9 | 480 | B |
| Practical example 4 | 5.1 | 4.8 | 270 | A |
| Practical example 5 | 5.3 | 4.9 | 295 | A |
| Comparative example 1 | 5.3 | 5.1 | 113 | B |
| Comparative example 2 | 5.2 | 4.4 | 163 | C |

As provided in Table 1, it was found that it may be possible to form a toner efficiently due to a specific embodiment of the present invention and its toner property may also be significantly good. Furthermore, an image obtained by conducting development using a toner manufactured according to a specific embodiment of the present invention was in accordance with an electrostatic latent image and significantly excellent in an image quality.

A method of manufacturing a toner according to a specific embodiment of the present invention and/or a toner manufactured thereby may be usable for a developer for developing an electrostatic charge image in an electro-photography, electrostatic recording, electrostatic printing, or the like, in which there may be found no or little fluctuation caused by a particle which fluctuation has been found in a conventional manufacturing method, in many characteristic values required for a toner such as a fluidity and a charging characteristic, because it may be possible to produce a toner efficiently and further it is a particle having a monodispersive particle size which has not been present conventionally.

[Appendix]

Typical embodiments (1) to (19) of the present invention are described below.

Embodiment (1)

A method of manufacturing a toner, characterized in that liquid drop forming means having a storage part for storing a toner composition liquid in which a toner composition containing at least a resin and a coloring agent is dispersed or dissolved, a thin film on which a nozzle facing the storage part is formed, and vibration generating means for vibrating the thin film via the toner composition liquid in the storage part, wherein plural storage chambers partitioned by a partition wall(s) are formed in the storage part and its width in a direction of arrangement of the plural storage chambers and its width in a direction orthogonal to the direction of arrangement of the storage chambers are formed to be one-half or less of a wavelength λ of a sonic wave generated in the storage part, are used to conduct a periodic liquid drop forming process for periodically forming and ejecting a liquid drop of the toner composition liquid from the plural nozzles and a particle forming process for solidifying the ejected liquid drop of the toner composition liquid.

Embodiment (2)

The method of manufacturing a toner as described in embodiment (1) above, characterized in that the storage part is provided with a common flow channel communicating with the plural storage chambers and the common flow channel is communicated with a liquid supplying pipe to which the toner composition liquid is supplied from an outside and a liquid draining pipe for draining the toner composition liquid.

Embodiment (3)

The method of manufacturing a toner as described in embodiment (1) or (2) above, characterized in that the thin film of the liquid drop forming means is vibrated at a vibration frequency of 20 kHz or more and 2.0 MHz or less.

Embodiment (4)

The method of manufacturing a toner as described in any of embodiments (1) to (3) above, characterized in that 1,000 to 10,000 nozzles corresponding to one partitioned liquid chamber area are formed on the thin film.

Embodiment (5)

The method of manufacturing a toner as described in any of embodiments (1) to (4) above, characterized in that the liquid drop is dried in a solvent removing part for removing a solvent of a liquid drop of the toner composition liquid in the particle forming process.

Embodiment (6)

The method of manufacturing a toner as described in any of embodiments (1) to (4) above, characterized in that drying is conducted in a cooling part for cooling a liquid drop of the toner composition liquid in the particle forming process.

Embodiment (7)

The method of manufacturing a toner as described in any of embodiments (1) to (4) above, characterized in that a liquid drop of the toner composition liquid is delivered and its solvent is removed by means of a dry gas flowing in a direction identical to an ejection direction of a liquid drop of the toner composition liquid in the particle forming process.

Embodiment (8)

The method of manufacturing a toner as described in embodiment (7) above, characterized in that the dry gas is air or nitrogen gas.

Embodiment (9)

A device of manufacturing a toner, characterized in that it is provided with periodic liquid drop forming means which use liquid drop forming means having a storage part for storing a toner composition liquid in which a toner composition containing at least a resin and a coloring agent is dispersed or dissolved, a thin film on which a nozzle facing the storage part is formed, and vibration generating means for vibrating the thin film via the toner composition liquid in the storage part, wherein plural storage chambers partitioned by a partition wall(s) are formed in the storage part and its width in a direction of arrangement of the plural storage chambers and its width in a direction orthogonal to the direction of arrangement of the storage chambers are formed to be one-half or less of a wavelength λ of a sonic wave generated in the storage part, to form and eject a liquid drop of the toner composition liquid from the plural nozzles periodically, and particle forming means for solidifying the ejected liquid drop of the toner composition liquid.

Embodiment (10)

The device of manufacturing a toner as described in embodiment (9) above, characterized in that the storage part is provided with a common flow channel communicating with the plural storage chambers and the common flow channel is communicated with a liquid supplying pipe to which the toner composition liquid is supplied from an outside and a liquid draining pipe for draining the toner composition liquid.

Embodiment (11)

The device of manufacturing a toner as described in embodiment (9) or (10) above, characterized in that the thin film of the liquid drop forming means is vibrated at a vibration frequency of 20 kHz or more and 2.0 MHz or less.

Embodiment (12)

The device of manufacturing a toner as described in any of embodiments (9) to (11) above, characterized in that 1,000 to 10,000 nozzles corresponding to one partitioned liquid chamber area are formed on the thin film.

Embodiment (13)

The device of manufacturing a toner as described in any of embodiments (9) to (12) above, characterized in that the particle forming means are provided with a solvent removing part for removing and drying a solvent of a liquid drop of the toner composition liquid.

Embodiment (14)

The device of manufacturing a toner as described in any of embodiments (9) to (11) above, characterized in that the particle forming means are provided with a cooling part for cooling and drying a liquid drop of the toner composition liquid.

Embodiment (15)

The device of manufacturing a toner as described in any of embodiments (9) to (15) above, characterized in that the particle forming means are provided with means for delivering a liquid drop of the toner composition liquid and removing its solvent by means of a dry gas flowing in a direction identical to an ejection direction of a liquid drop of the toner composition liquid.

Embodiment (16)

The device of manufacturing a toner as described in embodiment (15) above, characterized in that the dry gas is air or nitrogen gas.

Embodiment (17)

A toner characterized in that it is manufactured by the method of manufacturing a toner as described in any of embodiments (1) to (8) above.

Embodiment (18)

The toner as described in embodiment (17), characterized in that its particle size distribution (weight average particle diameter/number average particle diameter) is in a range of 1.00-1.15.

Embodiment (19)

The toner as described in embodiment (17) or (18) above, characterized in that its weight average particle diameter is 1-20 μm.

Although the illustrative embodiments and specific examples of the present invention have been described above with reference to the accompanying drawings, the present invention is not limited to any of the illustrative embodiments and specific examples, and the illustrative embodiments and specific examples may be altered, modified, or combined without departing from the scope of the present invention.

The present application claims the benefit of priority based on Japanese Patent Application No. 2008-224063 filed on Sep. 1, 2008 in Japan, the entire contents of which are hereby incorporated by reference herein.

What is claimed is:

1. A method of manufacturing a toner, wherein a liquid drop forming part comprising a storage part configured to store a toner composition liquid in which a toner composition comprising at least a resin and a coloring agent is dispersed or dissolved, a thin film on which a nozzle facing the storage part is formed, and a vibration generating part configured to vibrate the thin film via the toner composition liquid in the storage part are used to conduct a periodic liquid drop forming process configured to form and eject a liquid drop of the toner composition liquid from the plural nozzles periodically and a particle forming process configured to solidify the ejected liquid drop of the toner composition liquid, wherein plural storage chambers partitioned by a partition wall(s) are formed in the storage part and a width of each storage chamber in a direction of arrangement of the plural storage chambers and a width of each storage chamber in a direction orthogonal to the direction of arrangement of the storage chambers are formed to be one-half or less of a wavelength λ of a sonic wave generated in the storage part.

2. The method of manufacturing a toner as claimed in claim 1, wherein the storage part is provided with a common flow channel communicating with the plural storage chambers and the common flow channel is communicated with a liquid supplying pipe to which the toner composition liquid is supplied from an outside and a liquid draining pipe configured to drain the toner composition liquid.

3. The method of manufacturing a toner as claimed in claim 1, wherein the thin film of the liquid drop forming part is vibrated at a vibration frequency of 20 kHz or more and 2.0 MHz or less.

4. The method of manufacturing a toner as claimed in claim 1, wherein 1,000 to 10,000 nozzles corresponding to one partitioned liquid chamber area are formed on the thin film.

5. The method of manufacturing a toner as claimed in claim 1, wherein the liquid drop is dried in a solvent removing part configured to remove a solvent of a liquid drop of the toner composition liquid in the particle forming process.

6. The method of manufacturing a toner as claimed in claim 1, wherein drying is conducted in a cooling part configured to cool a liquid drop of the toner composition liquid in the particle forming process.

7. The method of manufacturing a toner as claimed in claim 1, wherein a liquid drop of the toner composition liquid is delivered and a solvent of the toner composition liquid is removed by a dry gas flowing in a direction identical to an ejection direction of a liquid drop of the toner composition liquid in the particle forming process.

8. The method of manufacturing a toner as claimed in claim 7, wherein the dry gas is air or nitrogen gas.

* * * * *